US009529290B2

(12) United States Patent
Shidahara et al.

(10) Patent No.: US 9,529,290 B2
(45) Date of Patent: Dec. 27, 2016

(54) PROCESS FOR PRODUCING ELECTROPHOTOGRAPHIC TONER

(71) Applicant: KAO CORPORATION, Chuo-ku (JP)

(72) Inventors: Yasuhiro Shidahara, Sumida-ku (JP); Manato Ikeda, Wakayama (JP); Hiroshi Mizuhata, Wakayama (JP); Koji Shimokusa, Wakayama (JP)

(73) Assignee: KAO CORPORATION, Chuo-ku (JP)

( * ) Notice: Subject to any disclaimer, the term of this patent is extended or adjusted under 35 U.S.C. 154(b) by 0 days.

(21) Appl. No.: 14/432,884

(22) PCT Filed: Oct. 4, 2013

(86) PCT No.: PCT/JP2013/077135

§ 371 (c)(1),
(2) Date: Apr. 1, 2015

(87) PCT Pub. No.: WO2014/054795

PCT Pub. Date: Apr. 10, 2014

(65) Prior Publication Data

US 2015/0277250 A1 Oct. 1, 2015

(30) Foreign Application Priority Data

Oct. 5, 2012 (JP) ..... 2012-223155

(51) Int. Cl.
*G03G 9/08* (2006.01)
*G03G 9/087* (2006.01)

(52) U.S. Cl.
CPC ..... *G03G 9/081* (2013.01); *G03G 9/0804* (2013.01); *G03G 9/08717* (2013.01); *G03G 9/08735* (2013.01); *G03G 9/08755* (2013.01); *G03G 9/08782* (2013.01); *G03G 9/08791* (2013.01); *G03G 9/08795* (2013.01); *G03G 9/08797* (2013.01)

(58) Field of Classification Search
CPC ... G03G 9/0804; G03G 9/081; G03G 9/08782
USPC ..... 430/137.14
See application file for complete search history.

(56) References Cited

U.S. PATENT DOCUMENTS

| | | | | |
|---|---|---|---|---|
| 2010/0183969 | A1* | 7/2010 | Suzuki | C08J 3/05 430/108.2 |
| 2011/0177445 | A1 | 7/2011 | Murata et al. | |
| 2011/0223531 | A1 | 9/2011 | Mizuhata et al. | |

FOREIGN PATENT DOCUMENTS

| | | | |
|---|---|---|---|
| JP | 2009-133946 | A | 6/2009 |
| JP | 2009-192699 | A | 8/2009 |
| JP | 2010-48954 | | 3/2010 |
| JP | 2010-276719 | A | 12/2010 |
| JP | 2011-186436 | | 9/2011 |
| JP | 2012-128024 | A | 7/2012 |
| JP | 2014-010386 | A | 1/2014 |
| WO | WO 2010/027071 | A1 | 3/2010 |
| WO | WO 2011/078410 | A1 | 6/2011 |
| WO | 2015/015927 | | 2/2015 |

OTHER PUBLICATIONS

International Search Report issued Jan. 14, 2014 in PCT/JP2013/077135 Filed Oct. 4, 2013.
U.S. Appl. No. 14/909,311, filed Feb. 1, 2016, Mizuhata, et al.
Extended European Search Report issued on Apr. 22, 2016 in Patent Application No. 13844377.5.
Japanese Official Action issued in corresponding Japanese Patent Application No. 2013-195517 dated Sep. 20, 2016.

* cited by examiner

*Primary Examiner* — Mark A Chapman

(74) *Attorney, Agent, or Firm* — Oblon, McClelland, Maier & Neustadt, L.L.P.

(57) ABSTRACT

The present invention relates to a process for producing a toner for electrophotography which is capable of suppressing liberation of a wax from a resin binder and exposure of the wax to a surface of respective toner particles in the step of obtaining fused particles upon production of the toner, and reducing a content of fine powders in the toner, and which is characterized by an excellent low-temperature fusing property and an excellent anti-high-temperature offset property. The process for producing a toner for electrophotography according to the present invention includes the following steps 1 to 3: Step 1 of mixing and emulsifying a wax, a resin emulsion containing a resin having an acid value of from 10 to 300 mgKOH/g, and an oxazoline group-containing polymer with each other to obtain a water dispersion of releasing agent particles; Step 2 of mixing and aggregating the water dispersion of the releasing agent particles obtained in the step 1 with a water dispersion of resin particles containing a carboxyl group-containing resin binder to obtain aggregated particles; and Step 3 of fusing the aggregated particles obtained in the step 2 to obtain fused particles.

12 Claims, No Drawings

PROCESS FOR PRODUCING ELECTROPHOTOGRAPHIC TONER

FIELD OF THE INVENTION

The present invention relates to a process for producing a toner for electrophotography which is used in electrophotographic method, electrostatic recording method, electrostatic printing method or the like.

BACKGROUND OF THE INVENTION

In the field of toners for electrophotography, with the progress of electrophotographic systems, it has been demanded to develop toners adaptable for high image quality and high copying speed. From the viewpoint of the high image quality, the toners have been required to have a small particle size. Thus, there has been reported a so-called chemical toner obtained by a chemical method such as a polymerization method and an emulsification and dispersion method in place of the conventional melt-kneading method. Further, from the viewpoint of the high copying speed, there has been proposed a toner to which a releasing agent is added as an internal additive in order to improve a low-temperature fusing property thereof.

For example, Patent Literature 1 aims at providing a toner for electrophotography which is excellent in low-temperature fusing property and anti-high-temperature offset property by preventing liberation of releasing agent particles from toner particles upon production of the toner, and discloses a process for producing a dispersion of a releasing agent for toners containing releasing agent particles which includes a step of mixing a dispersion of a releasing agent containing a carboxyl group and having an acid value of from 0.5 to 20 mgKOH/g and an oxazoline group-containing polymer. Also, Patent Literature 2 aims at providing a toner for electrophotography which is excellent in heat-resistant storage stability and has a wide fusing temperature range, and discloses a process for producing the toner for electrophotography which includes steps of melting and kneading a toner raw material containing a resin binder containing a polyester and a releasing agent, and emulsifying the resulting melted and kneaded product in an aqueous medium, followed by an aggregating step or a fusing step in which an oxazoline group-containing polymer is added to the resulting emulsion.

Patent Literature 1: JP 2009-133946A

Patent Literature 2: JP 2009-192699A

SUMMARY OF THE INVENTION

The present invention provides a process for producing a toner for electrophotography, including the following steps 1 to 3:

Step 1: mixing and emulsifying a wax, a resin emulsion containing a resin having an acid value of from 10 to 300 mgKOH/g, and an oxazoline group-containing polymer with each other to obtain a water dispersion of releasing agent particles;

Step 2: mixing and aggregating the water dispersion of the releasing agent particles obtained in the step 1 with a water dispersion of resin particles containing a carboxyl group-containing resin binder to obtain aggregated particles; and Step 3: fusing the aggregated particles obtained in the step 2 to obtain fused particles.

DETAILED DESCRIPTION OF THE INVENTION

The processes described in Patent Literatures 1 and 2 occasionally tend to fail to fully suppress liberation of the releasing agent from the fused particles into the aqueous medium upon production of the toner. In addition, in any of these processes, the presence of the releasing agent on a surface of the toner particles is observed, and there is therefore a possibility of causing inclusion of fine powders in the toner as well as insufficient tribocharge of the toner upon printing.

The present invention relates to a process for producing a toner for electrophotography which is capable of suppressing liberation of a wax from a resin binder and exposure of the wax to a surface of respective toner particles in the step of obtaining fused particles upon production of the toner, and reducing a content of fine powders (fines content) in the toner, and which is also characterized by an excellent low-temperature fusing property and an excellent anti-high-temperature offset property of the resulting toner.

The present invention provides a process for producing a toner for electrophotography, including the following steps 1 to 3:

Step 1: mixing and emulsifying a wax, a resin emulsion containing a resin having an acid value of from 10 to 300 mgKOH/g, and an oxazoline group-containing polymer with each other to obtain a water dispersion of releasing agent particles;

Step 2: mixing and aggregating the water dispersion of the releasing agent particles obtained in the step 1 with a water dispersion of resin particles containing a carboxyl group-containing resin binder to obtain aggregated particles; and Step 3: fusing the aggregated particles obtained in the step 2 to obtain fused particles.

According to the production process of the present invention, it is possible to suppress liberation of a wax from a resin binder and exposure of the wax to a surface of respective toner particles in the step of obtaining fused particles upon production of the toner, and reduce a content of fine powders in the toner, and there can be provided a toner for electrophotography which is excellent in low-temperature fusing property and anti-high-temperature offset property.

The process for producing a toner for electrophotography according to the present invention includes the following steps 1 to 3:

Step 1: mixing and emulsifying a wax, a resin emulsion containing a resin having an acid value of from 10 to 300 mgKOH/g, and an oxazoline group-containing polymer with each other to obtain a water dispersion of releasing agent particles;

Step 2: mixing and aggregating the water dispersion of the releasing agent particles obtained in the step 1 with a water dispersion of resin particles containing a carboxyl group-containing resin binder to obtain aggregated particles; and Step 3: fusing the aggregated particles obtained in the step 2 to obtain fused particles.

In the production process of the present invention, there is used the water dispersion of the releasing agent particles which is obtained by mixing and emulsifying the wax, the resin emulsion containing a resin having an acid value of from 10 to 300 mgKOH/g, and the oxazoline group-containing polymer with each other. By using the water dispersion, the releasing agent particles can be readily incorporated into the carboxyl group-containing resin binder, so that it is possible to suppress liberation of the wax from the aforementioned resin and exposure of the wax to a surface of the respective toner particles in the fusing step, and reduce a content of fine powders in the toner. In this case, by selecting the resin emulsion containing an acid group capable of reacting with an oxazoline group and functioning as an emulsifier for the wax, it is possible to suitably exhibit these effects.

In addition, the oxazoline group contained in the oxazoline group-containing polymer can be reacted with not only the acid group of the resin in the resin emulsion but also the carboxyl group contained in the resin binder, and further can also be reacted with a carboxyl group in the wax if the wax contains the carboxyl group.

<Step 1>

In the step 1, the wax, the resin emulsion containing a resin having an acid value of from 10 to 300 mgKOH/g, and the oxazoline group-containing polymer are mixed and emulsified with each other to obtain the water dispersion of the releasing agent particles.

The method of mixing these components is not particularly limited. From the viewpoints of sufficiently contacting the wax and the oxazoline group-containing polymer with each other, reducing a content of fine powders in the toner and attaining a good heat-resistant storage stability of the resulting toner, there is preferably used the method in which after mixing the wax with the oxazoline group-containing polymer, preferably after further stirring these components, the resulting mixture is mixed and emulsified with the resin emulsion to obtain the water dispersion of the releasing agent particles. The stirring means used in the method is preferably those having a strong shear force.

In the present invention, from the viewpoints of suppressing liberation of the wax from the toner particles, specifically from the fused particles, reducing a content of fine powders in the toner, and improving an anti-high-temperature offset property of the toner, upon production of the toner, it is possible to use a hydrocarbon wax and an ester wax, preferably a wax mixture containing both the hydrocarbon wax and the ester wax, as the aforementioned wax.

(Hydrocarbon Wax)

The hydrocarbon wax preferably acts as a releasing agent when using a crystalline polyester as the resin binder.

As the hydrocarbon wax, there may be used at least one wax selected from the group consisting of a low-molecular weight polypropylene, a low-molecular weight polyethylene, a low-molecular weight polypropylene/polyethylene copolymer, a microcrystalline wax, a paraffin wax, a Fischer-Tropsch wax and ceresin. Of these waxes, from the viewpoint of attaining a good releasing property of the toner upon use, preferred are hydrocarbon waxes having 16 to 40 carbon atoms, and more preferred is a paraffin wax.

The melting point of the hydrocarbon wax is preferably not lower than 50° C., more preferably not lower than 60° C., and still more preferably not lower than 70° C., from the viewpoints of suppressing liberation of the wax from the toner particles upon production of the toner and improving an anti-high-temperature offset property of the toner, and is also preferably not higher than 100° C., more preferably not higher than 95° C., and still more preferably not higher than 90° C., from the viewpoint of improving a low-temperature fusing property of the toner. The melting point may be measured using a differential scanning calorimeter, more concretely, may be measured by the method described below in Examples.

(Ester Wax)

The preferred ester wax used in the present invention contains a carboxyl group. When the carboxyl group contained in the ester wax is reacted with the oxazoline group contained in the oxazoline group-containing polymer, it is possible to suppress liberation of the releasing agent from the toner particles, more concretely, from the fused particles.

The acid value of the ester wax used in the present invention is preferably not less than 0.5 mgKOH/g, more preferably not less than 0.7 mgKOH/g, still more preferably not less than 1 mgKOH/g, and even still more preferably not less than 3 mgKOH/g, from the viewpoint of a high reactivity of the wax with the oxazoline group-containing polymer, and is also preferably not more than 20 mgKOH/g, more preferably not more than 17 mgKOH/g, still more preferably not more than 15 mgKOH/g, and even still more preferably not more than 10 mgKOH/g, from the viewpoint of ensuring a good tribocharge of the toner.

Examples of the ester wax used in the present invention include at least one wax selected from the group consisting of a vegetable wax, a natural or synthetic ester-based wax containing a long-chain aliphatic group, and an esterified product of an acid-modified polyethylene wax. Specific examples of the vegetable wax include at least one wax selected from the group consisting of a carnauba wax, a rice wax and a candelilla wax. Specific examples of the esterified product of the acid-modified polyethylene wax include those waxes produced by esterifying an acid-modified polyolefin obtained by modifying a polyolefin with a carboxylic acid, with an alcohol, and the like. Of these ester waxes, from the viewpoints of suppressing liberation of the wax from the toner particles upon production of the toner and improving a low-temperature fusing property and an anti-high-temperature offset property of the toner, preferred is a vegetable wax, and more preferred is a carnauba wax.

The melting point of the ester wax is preferably not lower than 50° C., more preferably not lower than 60° C., and still more preferably not lower than 70° C., from the viewpoints of suppressing liberation of the wax from the toner particles upon production of the toner and improving an anti-high-temperature offset property of the toner, and is also preferably not higher than 100° C., more preferably not higher than 95° C., and still more preferably not higher than 90° C., from the viewpoint of improving a low-temperature fusing property of the toner. The melting point may be measured using a differential scanning calorimeter (DSC), more concretely, may be measured by the method described below in Examples.

The mass ratio of the ester wax to the hydrocarbon wax as a mass ratio "ester wax/hydrocarbon wax" in the wax mixture is preferably not less than 5/95, more preferably not less than 10/90, and still more preferably not less than 20/80, from the viewpoints of suppressing liberation of the wax from the toner particles upon production of the toner and improving an anti-high-temperature offset property of the toner, and is also preferably not more than 70/30, more preferably not more than 50/50, still more preferably not more than 40/60, even still more preferably not more than 35/65, and further even still more preferably not more than 30/70, from the viewpoint of a good releasing property of the toner, and thus is preferably from 5/95 to 70/30, more preferably from 10/90 to 50/50, still more preferably from 10/90 to 40/60, and even still more preferably from 20/80 to 30/70.

The method of mixing the hydrocarbon wax and the ester wax is not particularly limited. For example, there is preferably used the method of mixing both the waxes after they are melted.

The total content of the hydrocarbon wax and the ester wax in the wax mixture is preferably not less than 80% by mass, more preferably not less than 90% by mass, and still more preferably substantially 100% by mass on the basis of a whole amount of the wax mixture, from the viewpoints of suppressing liberation of the wax from the toner particles upon production of the toner and improving a low-temperature fusing property and an anti-high-temperature offset property of the toner.

(Oxazoline Group-Containing Polymer)

The oxazoline group-containing polymer may be obtained by polymerizing an oxazoline group-containing polymerizable monomer or by copolymerizing the oxazoline group-containing polymerizable monomer with the other polymerizable monomer that is copolymerizable therewith, if required. The polymerizable monomer that is copolymerizable with the oxazoline group-containing polymerizable monomer as used herein may include both a polymerizable monomer containing an oxazoline group and a polymerizable monomer containing no oxazoline group.

The oxazoline group-containing polymerizable monomer is not particularly limited. As the oxazoline group-containing polymerizable monomer, there may be used at least one monomer selected from the group consisting of 2-vinyl-2-oxazoline, 2-vinyl-4-methyl-2-oxazoline, 2-vinyl-5-methyl-2-oxazoline, 2-isopropenyl-2-oxazoline, 2-isopropenyl-4-methyl-2-oxazoline, 2-isopropenyl-5-methyl-2-oxazoline and 2-isopropenyl-5-ethyl-2-oxazoline. Of these oxazoline group-containing polymerizable monomers, 2-isopropenyl-2-oxazoline is preferred from the viewpoint of a good availability.

Of the polymerizable monomers that are copolymerizable with the oxazoline group-containing polymerizable monomer, the polymerizable monomers containing no oxazoline group are not particularly limited. As the polymerizable monomers containing no oxazoline group, there may be used at least one monomer selected from the group consisting of (meth)acrylic acid esters, (meth)acrylic acid salts, unsaturated nitriles, unsaturated amides, vinyl esters, vinyl ethers, α-olefins, halogen-containing α,β-unsaturated aliphatic hydrocarbons, and α,β-unsaturated aromatic hydrocarbons.

The content of the oxazoline group in the oxazoline group-containing polymer may be measured by $^1$H NMR in $CDCl_3$, and is preferably not less than 0.1 mmol/g, more preferably not less than 0.5 mmol/g, and still more preferably not less than 1 mmol/g, from the viewpoint of suppressing liberation of the wax from the carboxyl group-containing resin binder upon production of the toner, and is also preferably not more than 50 mmol/g, more preferably not more than 20 mmol/g, and still more preferably not more than 10 mmol/g, from the viewpoint of a high reaction density.

The number-average molecular weight of the oxazoline group-containing polymer is not particularly limited, and is preferably not less than 500, and more preferably not less than 1,000, from the viewpoint of a good reaction efficiency of the oxazoline group, and is also preferably not more than 2,000,000, more preferably not more than 1,000,000, still more preferably not more than 100,000, and even still more preferably not more than 50,000, from the viewpoint of a good handling property. When the number-average molecular weight of the oxazoline group-containing polymer is not less than 500, it is possible to conduct a sufficient crosslinking reaction between the releasing agent particles and the resin particles, whereas when the number-average molecular weight of the oxazoline group-containing polymer is not more than 2,000,000, it is possible to adjust a viscosity of the polymer to an adequate level and attain a good handling property thereof.

Examples of commercially available ordinary products of the oxazoline group-containing polymer include EPOCROSS WS series (water-soluble type) and K series (emulsion type) both available from Nippon Shokubai Co., Ltd.

(Resin Emulsion)

The acid value of the resin in the resin emulsion used in the present invention is from 10 to 300 mgKOH/g. The resin emulsion functions as an emulsifier for the wax. When the acid value of the resin in the resin emulsion lies within the aforementioned range, the resin emulsion contains an acid group therein, and it is therefore possible to suppress liberation of the wax from the carboxyl group-containing resin binder and exposure of the wax to a surface of the toner upon production of the toner, and reduce a content of finer powders in the toner. The acid value of the resin in the resin emulsion is preferably not less than 15 mgKOH/g, more preferably not less than 50 mgKOH/g, and still more preferably not less than 100 mgKOH/g, from the viewpoint of a high reactivity with the oxazoline group-containing polymer, and is also preferably not more than 270 mgKOH/g, more preferably not more than 250 mgKOH/g, and still more preferably not more than 200 mgKOH/g, from the viewpoint of preparing the resin emulsion.

The resin emulsion is preferably in the form of an emulsion of a resin containing a carboxyl group as the acid group. The acid value of the resin in the resin emulsion is preferably derived from the carboxyl group.

As the resin emulsion, there may be used at least one resin emulsion selected from the group consisting of a vinyl chloride-based resin emulsion, an acryl-based resin emulsion and a polyester resin emulsion. Of these resin emulsions, from the viewpoint of a good heat-resistant storage stability of the toner, preferred are a vinyl chloride-based resin emulsion and/or an acryl-based resin emulsion, and more preferred is a vinyl chloride-based resin emulsion.

The vinyl chloride-based resin emulsion preferably contains a resin obtained by polymerizing, preferably emulsion-polymerizing, a vinyl chloride monomer, if required, with at least one monomer copolymerizable with the vinyl chloride monomer. Examples of the monomer copolymerizable with the vinyl chloride monomer include an acrylic monomer, vinyl acetate and the like.

In addition, there may also be used such a vinyl chloride-based resin emulsion as described in WO 2010/140647A which is obtained by polymerizing, preferably emulsion-polymerizing, a vinyl chloride monomer with at least one monomer copolymerizable with the vinyl chloride monomer in the presence of a styrene-acrylic oligomer and/or an acrylic acid ester oligomer.

Examples of the acryl-based resin emulsion include at least one resin emulsion selected from the group consisting of an acrylic resin emulsion, a styrene-acrylic copolymer resin emulsion, a vinyl acetate-acrylic copolymer resin emulsion, a silicone-acrylic resin emulsion, a polyester-acrylic resin emulsion, a urethane-acrylic resin emulsion, a modified acrylic emulsion, a self-crosslinking type acrylic acid ester resin emulsion, and an ethylene-vinyl acetate-acrylic resin emulsion.

The acryl-based resin emulsion preferably contains an acrylic resin obtained by polymerizing, for example, emulsion-polymerizing, an acrylic monomer solely, or the acrylic monomer with at least one monomer copolymerizable with the acrylic monomer. Further, there may also be used a monomer that can be reacted and crosslinked with these acrylic copolymers.

Examples of the acrylic monomer include (meth)acrylic acid and (meth)acrylic acid esters. Specific examples of the (meth)acrylic acid esters include (meth)acrylic acid alkyl esters containing an alkyl group having 1 to 18 carbon atoms which may contain a hydroxyl group, such as methyl (meth) acrylate, ethyl (meth)acrylate, isopropyl(meth)acrylate, butyl (meth)acrylate, isobutyl (meth)acrylate, amyl(meth) acrylate, hexyl(meth)acrylate, octyl(meth)acrylate, 2-ethylhexyl(meth)acrylate, decyl(meth)acrylate, dodecyl(meth) acrylate, hydroxyethyl (meth)acrylate and hydroxypropyl (meth)acrylate. The "(meth)acrylic" as used herein means acrylic, methacrylic or a mixture thereof.

Specific examples of the monomer copolymerizable with the acrylic monomer include at least one monomer selected from the group consisting of ethylene, vinyl acetate, vinylidene chloride, maleic anhydride, fumaric anhydride, styrene, 2-methyl styrene, chlorostyrene, acrylonitrile, vinyl toluene, N-methylol acrylamide, N-methylol methacrylamide, N-butoxymethyl acrylamide, N-butoxymethyl methacrylamide, vinyl pyridine and N-vinyl pyrrolidone.

The polyester resin may be either a crystalline polyester resin or a non-crystalline polyester resin. The kinds and production methods of these resins are the same as those of the below-mentioned crystalline polyester (a1) and non-crystalline polyester (a2), and these resins may be produced by the same methods as described hereinafter in which an acid component and an alcohol component are subjected to polycondensation reaction.

Meanwhile, from the viewpoint of facilitated production of the resin emulsion, a surfactant may be used therein, if required. However, if the content of the surfactant in the resin emulsion is excessively large, there tends to occur such a fear that the resin emulsion is adsorbed on an interface with the wax when emulsifying the wax.

Therefore, the content of the surfactant in the resin emulsion is preferably not more than 10% by mass, more preferably not more than 5% by mass, still more preferably not more than 3% by mass, and most preferably substantially 0% by mass on the basis of solid components contained in the resin emulsion.

The resin emulsion using no surfactant is commercially available as a soap-free type, and therefore not particularly limited. Examples of the commercially available resin emulsion of a soap free type include "VINYBLAN 700" and "VINYBLAN 701" both in the form of a vinyl chloride copolymer emulsion available from Nissin Chemical Industry Co., Ltd.

The glass transition point of the resin used in the resin emulsion is preferably not lower than 50° C., more preferably not lower than 55° C., and still more preferably not lower than 60° C., from the viewpoint of a good anti-high-temperature offset property and a good storage stability of the toner, and is also preferably not higher than 90° C., more preferably not higher than 85° C., and still more preferably not higher than 80° C., from the viewpoint of a good low-temperature fusing property of the toner.

The volume-median particle size of the resin emulsion is preferably from 0.01 to 0.5 μm, more preferably from 0.02 to 0.3 and still more preferably from 0.03 to 0.2 μm, from the viewpoint of adsorbing the resin emulsion onto the releasing agent particles to emulsify the particles therein. Meanwhile, the volume-median particle size as used herein means a particle size at which a cumulative volume frequency calculated on the basis of a volume fraction of the particles from a smaller particle size side thereof is 50%.

The solid content (or resin) content of the resin emulsion in the water dispersion of the releasing agent particles is preferably not less than 0.1 part by mass, more preferably not less than 0.5 part by mass, still more preferably not less than 1 part by mass, even still more preferably not less than 1.5 parts by mass, and further even still more preferably not less than 2 parts by mass, on the basis of 100 parts by mass of a whole amount of the wax, from the viewpoints of suppressing liberation of the wax, attaining a good heat-resistant storage stability and preventing deterioration of a tribocharge of the toner, and is also preferably not more than 40 parts by mass, more preferably not more than 30 parts by mass, still more preferably not more than 15 parts by mass, even still more preferably not more than 10 parts by mass, and further even still more preferably not more than 8 parts by mass, on the basis of 100 parts by mass of a whole amount of the wax, from the viewpoint of suppressing liberation of the wax. Meanwhile, the resin content of the resin emulsion may be regarded as being identical to the solid content of the resin emulsion.

(Mixing of Wax or Wax Mixture with Oxazoline Group-Containing Polymer)

When using the aforementioned wax mixture, it is preferred that after preparing the wax mixture, the oxazoline group-containing polymer is mixed with the resulting wax mixture.

The stirring means used upon mixing the wax or wax mixture with the oxazoline group-containing polymer is not particularly limited, and there may be used a homogenizer having a strong shear force, a pressure discharge homogenizer, an ultrasonic disperser or the like. In addition, there may also be used "Homo Mixer" and "Disper" (tradenames) both available from PRIMIX Corporation, "Clearmix" (tradename) available from M Technique Co., Ltd., "Cavitron" (tradename) available from Pacific Machinery & Engineering Co., Ltd., or the like. Meanwhile, when using the "Disper", the stirring is preferably carried out for 5 min or longer while maintaining the whole components in a uniformly mixed state.

The temperature used upon mixing the wax or wax mixture with the oxazoline group-containing polymer is preferably not lower than 50° C., more preferably not lower than 55° C., still more preferably not lower than 60° C., even still more preferably not lower than 70° C., and further even still more preferably not lower than 80° C., from the viewpoints of melting the wax and efficiently reacting the oxazoline group of the oxazoline group-containing polymer with the carboxyl group of the ester wax, and is also preferably not higher than 120° C., more preferably not higher than 99° C., still more preferably not higher than 98° C., and even still more preferably not higher than 96° C., from the viewpoint of a good operating property. Meanwhile, the mixing of the respective components at a temperature of not lower than 100° C. becomes possible, for example, by applying a pressure thereto.

The molar ratio of the carboxyl group in the wax or wax mixture to the oxazoline group in the oxazoline group-containing polymer (carboxyl group/oxazoline group) is preferably not less than 0.01, more preferably not less than 0.02, and still more preferably not less than 0.05, from the viewpoints of suppressing liberation of the wax from the fused particles upon production of the toner and attaining a good anti-high-temperature offset property of the toner, and is also preferably not more than 3, more preferably not more than 2, and still more preferably not more than 1, from the viewpoint of avoiding deterioration of a tribocharge of the toner.

(Emulsification)

The wax the resin emulsion containing the resin having an acid value of from 10 to 300 mgKOH/g and the oxazoline group-containing polymer are mixed and emulsified with each other to obtain a water dispersion of releasing agent particles.

The order of addition of the respective components is not particularly limited. As described previously, it is preferred that after mixing the wax or wax mixture with the oxazoline group-containing polymer, the resin emulsion is added and mixed in the resulting mixture. The resin emulsion containing the resin having an acid value of from 10 to 300 mgKOH/g acts as an emulsifier for the wax, so that the effects of the present invention, i.e., the effect of preventing liberation of the wax upon production of the toner, the effect of suppressing exposure of the wax to a surface of the toner and the effect of reducing a content of finer powders in the toner can be achieved.

In addition, it is preferred that the mixture prepared above is emulsified to obtain a preliminary emulsion, and further the thus obtained preliminary emulsion is finely dispersed using a high-pressure emulsifying and dispersing apparatus while heating the emulsion to a temperature not lower than a melting point of the wax or a melting point of the wax mixture. With the aforementioned procedure, it is possible to obtain a water dispersion of the releasing agent particles having a volume-median particle size ($D_{50}$) of 1000 nm or less.

The aqueous medium used for preparing the water dispersion of the releasing agent particles may be the same aqueous medium as used upon emulsifying the below-mentioned resin binder. From the viewpoints of a good environmental suitability and facilitated addition of the aqueous medium upon production of the toner, the use of deionized water or distilled water is preferred. The aqueous medium may be either the aqueous medium already contained in the resin emulsion or a fresh aqueous medium further added thereto.

The stirring means used upon preparing the preliminary emulsion is not particularly limited, and there may be used a homogenizer having a strong shear force, a pressure discharge homogenizer, an ultrasonic disperser or the like. In addition, there may also be used "Homo Mixer" and "Disper" (tradenames) both available from PRIMIX Corporation, "Clearmix" (tradename) available from M Technique Co., Ltd., "Cavitron" (tradename) available from Pacific Machinery & Engineering Co., Ltd., or the like. Meanwhile, when using the "Disper", the stirring is preferably carried out for 5 min or longer while maintaining the whole components in a uniformly mixed state.

In addition, the thus obtained preliminary emulsion is finely dispersed using a high-pressure emulsifying and dispersing apparatus while heating the emulsion to a temperature not lower than a melting point of the wax or a melting point of the wax mixture, thereby obtaining the water dispersion of the releasing agent particles.

The method of heating the preliminary emulsion to a temperature not lower than the melting point of the wax is not particularly limited, and there is preferably used the method in which after obtaining the preliminary emulsion, at least a part of a flow passage extending to a high-pressure dispersing portion of the high-pressure emulsifying and dispersing apparatus, if required, a whole portion of the flow passage, is heated to a temperature not lower than the melting point of the wax. More specifically, there may be mentioned a method of heating the flow passage from inside and outside using a jacket or a heating medium, a method of adding a warm water or the like to the preliminary emulsion, a method of raising a temperature of the flow passage by infrared radiation, microwave, induction heating or the like. Of these methods, in particular, the method in which the flow passage of the high-pressure emulsifying and dispersing apparatus is dipped in a heating medium such as a heated oil or warm water. In this case, the heating medium is preferably adjusted to a temperature higher by about 5 to about 30° C., more preferably by about 10 to about 25° C., and still more preferably by about 15 to about 20° C., than the melting point of the wax. Furthermore, it is preferred that a portion of the flow passage disposed immediately before the high-pressure dispersing portion where the preliminary emulsion is subjected to high-pressure dispersing treatment is heated.

The temperature used upon emulsifying the wax, the resin emulsion containing the resin having an acid value of from 10 to 300 mgKOH/g and the oxazoline group-containing polymer is preferably not lower than 50° C., more preferably not lower than 55° C., still more preferably not lower than 60° C., even still more preferably not lower than 70° C., and further even still more preferably not lower than 80° C., from the viewpoints of efficiently reacting the oxazoline group of the oxazoline group-containing polymer with the acid group of the resin emulsion, and further with the carboxyl group of the wax if the wax contains the carboxyl group, and melting the wax to emulsify the wax with the resin emulsion, and is also preferably not higher than 120° C., more preferably not higher than 99° C., still more preferably not higher than 98° C., and even still more preferably not higher than 96° C., from the viewpoint of a good operating property. The mixing of the respective components at a temperature of not lower than 100° C. may be performed, for example, by applying a pressure thereto.

The molar ratio of the acid group in the resin emulsion to the oxazoline group in the oxazoline group-containing polymer (acid group/oxazoline group), or the molar ratio of the carboxyl group in the resin emulsion to the oxazoline group in the oxazoline group-containing polymer (carboxyl group/oxazoline group) in the case where the acid group in the resin emulsion is the carboxyl group, is preferably not less than 0.05, more preferably not less than OA, still more preferably not less than 0.2, and even still more preferably not less than 0.5, from the viewpoint of suppressing liberation of the wax from the fused particles upon production of the toner, and is also preferably not more than 10, more preferably not more than 8, and still more preferably not more than 5, from the viewpoint of avoiding deterioration of a tribocharge of the toner.

The high-pressure emulsifying and dispersing apparatus used in the present invention is not particularly limited. From the viewpoints of obtaining particles having a small particle size and attaining a simple and convenient handling operation, there may be used "Microfluidizer" available from Mizuho Industrial Co., Ltd., "Ultimizer" available from Sugino Machine Limited, "Nanomizer" available from Yoshida Kikai Co., Ltd., or the like. The structure of the high-pressure dispersing portion of the high-pressure emulsifying and dispersing apparatus is not particularly limited, and the high-pressure dispersing portion may be of any type, for example, a counter-current impingement type, a penetration type or the like.

The pressure used upon the high-pressure emulsification of the preliminary emulsion is preferably not less than 5 MPa, more preferably not less than 10 MPa, and still more preferably not less than 20 MPa, from the viewpoints of a suitable particle size and a good dispersibility of the resulting releasing agent particles, and is also preferably not more than 200 MPa, more preferably not more than 180 MPa, and still more preferably not more than 150 MPa, from the viewpoint of low production costs.

The number of frequencies of the high-pressure emulsification treatment may be adequately determined according to the aforementioned treating pressure, the particle size of the resulting releasing particles, etc., and is preferably from 1 to 10 times, and more preferably from 2 to 5 times.

After completion of the emulsification, the resulting emulsion is preferably cooled to a temperature of not higher than 30° C., and more preferably not higher than 20° C., and the lower limit of the cooling temperature is preferably not lower than 0° C., and more preferably not lower than 5° C., thereby obtaining the water dispersion of the releasing agent particles.

The cooling method is not particularly limited, and there may be used either a method of cooling the emulsion from inside and outside of a pipe or a method of directly adding cold water to the dispersion. In addition, since the dispersion containing particles having a particle size of 1 μm or less is usually kept stable, there may also be used a method in which the dispersion is once transferred into a vessel, and thereafter cooled therein under stirring using a jacket or the like.

The concentration of solid components in the water dispersion of the releasing agent particles upon the dispersing treatment is preferably not less than 5% by mass, more preferably not less than 10% by mass, and still more preferably not less than 15% by mass, and is also preferably not more than 60% by mass, more preferably not more than 50% by mass, and still more preferably not more than 30% by mass, from the viewpoints of a good emulsifying property and a high productivity.

The volume-median particle size ($D_{50}$) of the releasing agent particles in the resulting water dispersion is preferably not more than 1000 nm, more preferably not more than 900 nm, still more preferably not more than 800 nm, and even still more preferably not more than 700 nm, from the viewpoints of a good dispersibility of the wax in the toner and a good anti-high-temperature offset property of the toner, and is also preferably not less than 200 nm, more preferably not less than 300 nm, still more preferably not less than 400 nm, even still more preferably not less than 450 nm, and further even still more preferably not less than 500 nm, from the viewpoints of suppressing liberation (exposure) of the wax from the toner particles in the fusing step, and increasing a tribocharge of the toner. The volume-median particle size of the releasing agent particles may be measured using a particle size distribution measuring device, more specifically, by the method described below in Examples.

As the method of emulsifying the releasing agent such that the releasing agent particles emulsified have a desired volume-median-particle size, there may be used not only the aforementioned method of varying a pressure upon the high-pressure emulsification, but also the method of adding an acid or an alkali to the emulsion to control a pH value thereof. In the latter method, the extent of dissociation of the acid group (carboxyl group) in the resin emulsion is controlled by adjusting a pH value of the emulsion, whereby the resin emulsion is changed in its affinity to water between a hydrophilic property and a hydrophobic property, and is also changed in orientation thereof to the releasing agent, so that the particle size of the releasing agent particles is increased or decreased. When adding an acid to the resin emulsion, there is such a tendency that the particle size of the resulting releasing agent particles is increased, whereas when adding an alkali to the resin emulsion, there is such a tendency that the particle size of the resulting releasing agent particles is decreased. By increasing the particle size of the releasing agent particles, it is possible to suppress exposure of the wax to a surface of the toner and increase a tribocharge of the toner. On the other hand, by decreasing the particle size of the releasing agent particles, it is possible to well disperse the wax, so that the resulting toner is excellent in anti-high-temperature offset property. Examples of the acid include inorganic acids such as hydrochloric acid, acetic acid and sulfuric acid, and organic acids such as citric acid. Examples of the alkali include alkali metal hydroxides such as sodium hydroxide, and amines. The particle size of the releasing agent particles is preferably controlled to the aforementioned particle size range.

The pH value of the water dispersion of the releasing agent particles as measured at 20° C. is preferably not less than 6.0, more preferably not less than 6.5, and still more preferably not less than 7.0, from the viewpoint of a good stability of the resin emulsion, and is also preferably not more than 11.0, more preferably not more than 10.5, and still more preferably not more than 10.0, from the viewpoint of suppressing hydrolysis of the releasing agent.

<Step 2>

In the step 2, the water dispersion of the releasing agent particles obtained in the step 1 is mixed and aggregated with a water dispersion of resin particles containing a carboxyl group-containing resin binder to obtain aggregated particles.

The step 2 preferably includes the following step 2-1, and more preferably includes the following steps 2-1 and 2-2 from the viewpoint of suppressing liberation of the wax. When the step 2 includes the steps 2-1 and 2-2, the resulting toner particles are in the form of core/shell particles each containing a core portion constituted of resin particles (A) and a shell portion constituted of resin particles (B).

The carboxyl group-containing resin binder used in the present invention means the resin used in the step 2-1 and is preferably at least one resin selected from the group consisting of a crystalline polyester (a1) and a non-crystalline polyester (a2). When both the crystalline polyester (a1) and the non-crystalline polyester (a2) are used in the present invention, the resin binder contains both the crystalline polyester (a1) and the non-crystalline polyester (a2).

Step 2-1: mixing the water dispersion of the releasing agent particles obtained in the step 1 with a water dispersion of resin particles (A) containing a carboxyl group-containing resin binder and optionally with an aggregating agent in an aqueous medium to obtain aggregated particles (1).

Step 2-2: adding a water dispersion of resin particles (B) containing a non-crystalline polyester (b) to the aggregated particles (1) obtained in the step 2-1 to obtain aggregated particles (2).

[Resin Particles (A)]

(Carboxyl Group-Containing Resin Binder)

As the carboxyl group-containing resin binder, there may be used conventionally known resin binders for toners, for example, a polyester, a styrene-acrylic copolymer, an epoxy resin, a polycarbonate, a polyurethane or the like. Of these resin binders, from the viewpoints of a good fusing property and a good durability of the toner, preferred are those resin binders containing the polyester. The content of the polyester in the carboxyl group-containing resin binder is preferably not less than 60% by mass, more preferably not less than 70% by mass, still more preferably not less than 80% by mass, and even still more preferably substantially 100% by mass, on the basis of a total mass of the carboxyl group-containing resin binder, from the viewpoints of a good fusing property and a good durability of the toner.

The resin particles (A) containing the carboxyl group-containing resin binder preferably contain at least one resin selected from the group consisting of the crystalline polyester (a1) and the non-crystalline polyester (a2), and more preferably contain both of the crystalline polyester (a1) and the non-crystalline polyester (a2) from the viewpoint of improving a low-temperature fusing property and an anti-high-temperature offset property of the toner.

(Crystalline Polyester (a1))

In the present invention, from the viewpoint of a good low-temperature fusing property of the toner, the resin particles (A) preferably contain the crystalline polyester (a1).

The crystalline polyester (a1) used in the present invention is preferably obtained by polycondensing an alcohol component containing an am-alkanediol having 10 to 12 carbon atoms and an acid component containing an aliphatic dicarboxylic acid, from the viewpoint of a good low-temperature fusing property of the toner.

The "crystalline polyester" as used in the present invention means those polyesters having a crystallinity index of from 0.6 to 1.4 wherein the crystallinity index is defined by a ratio of a softening point to an endothermic maximum peak temperature as measured by a differential scanning colorimeter (DSC), i.e., "softening point (° C.)/endothermic maximum peak temperature (° C.)". The crystallinity index of the crystalline polyester is preferably from 0.8 to 1.3, more preferably from 0.9 to 1.2 and still more preferably from 0.9 to 1.1 from the viewpoint of a good low-temperature fusing property of the toner.

The crystalline polyester (a1) preferably contains a carboxyl group at a terminal end of a molecule thereof from the viewpoints of facilitating emulsification of the dispersion of the resin particles and enhancing a dispersion stability thereof.

The melting point of the crystalline polyester (a1) is preferably not lower than 50° C., more preferably not lower than 55° C., still more preferably not lower than 60° C., and even still more preferably not lower than 65° C., from the viewpoint of enhancing a storage stability of the toner, and is also preferably not higher than 100° C., more preferably not higher than 97° C., still more preferably not higher than 95° C., and even still more preferably not higher than 90° C., from the viewpoint of enhancing a low-temperature fusing property of the toner.

The softening point of the crystalline polyester (a1) is preferably not lower than 50° C., more preferably not lower than 60° C., still more preferably not lower than 65° C., and even still more preferably not lower than 70° C., from the viewpoint of enhancing a storage stability of the toner, and is also preferably not higher than 140° C., more preferably not higher than 120° C., still more preferably not higher than 110° C., and even still more preferably not higher than 100° C., from the viewpoint of enhancing a low-temperature fusing property of the toner.

The acid value of the crystalline polyester (a1) is preferably not less than 3 mgKOH/g, more preferably not less than 4 mgKOH/g, still more preferably not less than 5 mgKOH/g, and even still more preferably not less than 6 mgKOH/g, from the viewpoint of enhancing a dispersion stability of the dispersion of the resin particles and a reactivity thereof with the oxazoline group-containing polymer, and is also preferably not more than 30 mgKOH/g, more preferably not more than 25 mgKOH/g, still more preferably not more than 23 mgKOH/g, and even still more preferably not more than 20 mgKOH/g, form the viewpoint of ensuring a tribocharge of the toner.

Meanwhile, the crystalline polyester (a1) may be used singly or in combination of any two or more kinds thereof.

In the present invention, the melting point and softening point of the crystalline polyester (a1) may be determined by the methods described in Examples below. When using two or more kinds of crystalline polyesters (a1) in combination with each other, the melting point, softening point and number-average molecular weight thereof may be determined by the methods described below in Examples using a mixture containing all of the crystalline polyesters (a1) at their mass ratios upon use.

The crystalline polyester (a1) is preferably produced by polycondensing an alcohol component containing an α,ω-alkanediol having 10 to 12 carbon atoms and an acid component containing an aliphatic dicarboxylic acid. The polycondensation reaction is preferably conducted in the presence of a catalyst.

From the viewpoints of a good low-temperature fusing property of the toner and a high image density of the resulting printed images, the content of the aliphatic dicarboxylic acid in the acid component is preferably from 70 to 100 mol %, more preferably from 90 to 100 mol %, and still more preferably 100 mol %.

Examples of the aliphatic dicarboxylic acid include sebacic acid, fumaric acid, maleic acid, adipic acid, azelaic acid and succinic acid. Of these aliphatic dicarboxylic acids, preferred is succinic acid. Examples of the acid component other than the aliphatic dicarboxylic acid include alicyclic dicarboxylic acids, aromatic dicarboxylic acids and trivalent or higher-valent polycarboxylic acids.

The acid component may include, in addition to the free acid, an anhydride of the acid capable of being decomposed during the reaction to produce an acid thereof, and an alkyl (C1 to C3) ester of the acid. These acid components may be used alone or in combination of any two or more thereof.

From the viewpoint of further enhancing a low-temperature fusing property of the toner, the content of the α,ω-alkanediol having 10 to 12 carbon atoms in the alcohol component is preferably from 70 to 100 mol %, more preferably from 90 to 100 mol %, and still more preferably 100 mol %. Examples of the α,ω-alkanediol having 10 to 12 carbon atoms include 1,10-decanediol and 1,12-dodecanediol. Of these α,ω-alkanediols, from the viewpoint of enhancing a low-temperature fusing property of the toner, preferred is 1,12-dodecanediol.

These α,ω-alkanediols having 10 to 12 carbon atoms may be used alone or in combination of any two or more thereof.

Examples of the alcohol component other than the α,ω-alkanediol having 10 to 12 carbon atoms include aliphatic diols other hand the α,ω-alkanediol having 10 to 12 carbon atoms, aromatic diols, hydrogenated products of bisphenol A and trivalent or higher-valent polyhydric alcohols. Of these alcohol components, from the viewpoints of promoting crystallization of the polyester and enhancing a low-temperature fusing property of the toner, preferred are the aliphatic diols. The average number of carbon atoms contained in the alcohol component is preferably from 6 to 14, more preferably from 8 to 12, and still more preferably from 10 to 12, from the viewpoint of a good low-temperature fusing property of the toner.

From the viewpoint of a good low-temperature fusing property of the toner, the combination of the acid component and the alcohol component is preferably a combination of an acid component containing succinic acid in an amount of from 70 to 100 mol % and an alcohol component containing the α,ω-alkanediol having 10 to 12 carbon atoms in an amount of from 70 to 100 mol %, and more preferably a combination of succinic acid and the α,ω-alkanediol having 10 to 12 carbon atoms.

From the viewpoint of enhancing an efficiency of the polycondensation reaction, as the catalyst, there is preferably used a tin compound or a titanium compound, more preferably a tin compound, and still more preferably tin di(2-ethyl hexanoate) or dibutyl tin oxide.

Examples of the titanium compound include titanium diisopropylate bistriethanol aminate and the like.

The amount of the catalyst used is preferably from 0.01 to 1 part by mass and more preferably from 0.1 to 0.6 part by mass on the basis of 100 parts by mass of a total amount of the acid component and the alcohol component.

The polycondensation reaction is preferably carried out by charging the acid component and the alcohol component into a reaction vessel and maintaining the contents of the reaction vessel at a temperature of from 140 to 200° C. for 5 to 15 h. Thereafter, the catalyst is added to the reaction vessel, and the contents of the reaction vessel are maintained at a temperature of from 140 to 200° C. for 1 to 5 h to allow the reaction to proceed, and then the reaction pressure is reduced to 5.0 to 20 kPa under which the reaction solution is maintained for 1 to 10 h.

(Non-Crystalline Polyester (a2))

The resin particles (A) preferably further contain a non-crystalline polyester (a2) from the viewpoints of enhancing a heat-resistant storage stability and a tribocharge of the toner and preventing occurrence of high-temperature offset while maintaining a good low-temperature fusing property of the toner.

In the present invention, the "non-crystalline polyester" as used herein means a polyester resin having a crystallinity index of more than 1.4 or less than 0.6. The crystallinity index of the non-crystalline polyester (a2) is preferably less than 0.6 or more than 1.4 but not more than 4, more preferably less than 0.6 or not less than 1.5 but not more than 4, still more preferably less than 0.6 or not less than 1.5 but not more than 3, and even still more preferably less than 0.6 or not less than 1.5 but not more than 2 from the viewpoint of a good low-temperature fusing property of the toner. The crystallinity index of the non-crystalline polyester (a2) may be appropriately determined according to the kinds and proportions of the raw material monomers used, production conditions (such as, e.g., reaction temperature, reaction time and cooling rate), etc.

The non-crystalline polyester (a2) preferably contains a carboxyl group at a terminal end of a molecule thereof from the viewpoints of facilitating emulsification of the dispersion of the resin particles and enhancing a dispersion stability thereof.

The non-crystalline polyester (a2) may be produced by subjecting an acid component and an alcohol component to polycondensation reaction according to the same method as used for production of the above crystalline polyester (a1).

Examples of the acid component include dicarboxylic acids, trivalent or higher-valent polycarboxylic acids, and anhydrides and alkyl ($C_1$ to $C_3$) esters of these acids. Of these acids, preferred are dicarboxylic acids.

Specific examples of the dicarboxylic acids include succinic acids substituted with an alkyl group having 1 to 20 carbon atoms or an alkenyl group having 2 to 20 carbon atoms, such as dodecylsuccinic acid, dodecenylsuccinic acid and octenylsuccinic acid, phthalic acid, isophthalic acid, terephthalic acid, sebacic acid, fumaric acid, maleic acid, adipic acid, azelaic acid, succinic acid and cyclohexanedicarboxylic acid. Of these dicarboxylic acids, preferred are fumaric acid, dodecenylsuccinic acid and terephthalic acid, and more preferred are dodecenylsuccinic acid and terephthalic acid.

Specific examples of the trivalent or higher-valent polycarboxylic acids include trimellitic acid, 2,5,7-naphthalenetricarboxylic acid and pyromellitic acid. Among these polycarboxylic acids, preferred are trimellitic acid and trimellitic anhydride from the viewpoint of a good anti-offset property.

These acid components may be used alone or in combination of any two or more thereof.

The non-crystalline polyester (a2) preferably contains at least one non-crystalline polyester obtained by using an acid component preferably containing a trivalent or higher-valent polycarboxylic acid, or an anhydride or an alkyl ester thereof, and more preferably trimellitic acid or trimellitic anhydride, from the viewpoint of a good anti-high-temperature offset property of the toner.

Examples of the alcohol component include aliphatic diols with a main chain having 2 to 12 carbon atoms, aromatic diols, hydrogenated products of bisphenol A and trivalent or higher-valent polyhydric alcohols. Specific examples of the trivalent or higher-valent polyhydric alcohols include glycerol and pentaerythritol.

Of these alcohol components, from the viewpoint of obtaining the non-crystalline polyester, preferred are aromatic diols, and more preferred are alkylene ($C_2$ to $C_3$) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane.

These alcohol components may be used alone or in combination of any two or more thereof.

The glass transition point of the non-crystalline polyester (a2) is preferably not lower than 50° C., and more preferably not lower than 55° C., from the viewpoints of a good anti-high-temperature offset property and a good storage stability of the toner, and is also preferably not higher than 85° C., more preferably not higher than 75° C., and still more preferably not higher than 70° C., from the viewpoint of a good low-temperature fusing property of the toner.

The softening point of the non-crystalline polyester (a2) is preferably not lower than 70° C., more preferably not lower than 90° C., and still more preferably not lower than 100° C., from the viewpoints of a good anti-high-temperature offset property and a good storage stability of the toner, and is also preferably not higher than 165° C., more preferably not higher than 140° C., and still more preferably not higher than 130° C., from the viewpoint of a good low-temperature fusing property of the toner.

The number-average molecular weight of the non-crystalline polyester (a2) is preferably from 1,000 to 100,000, more preferably from 1,500 to 60,000, still more preferably from 1,600 to 30,000, and even still more preferably from 1,700 to 10,000, from the viewpoints of a good low-temperature fusing property and a good anti-high-temperature offset property of the toner.

The acid value of the non-crystalline polyester (a2) is preferably not less than 6 mgKOH/g, more preferably not less than 10 mgKOH/g, and still not less than 15 mgKOH/g, from the viewpoint of enhancing a dispersion stability of the dispersion of the resin particles and a reactivity thereof with the oxazoline group-containing polymer, and is also preferably not more than 35 mgKOH/g, and more preferably not more than 30 mgKOH/g, from the viewpoint of ensuring a good tribocharge of the toner.

The non-crystalline polyester (a2) preferably contains two or more kinds of polyesters which are different in softening point from each other from the viewpoints of a good low-temperature fusing property and a good anti-high-temperature offset property of the toner. Among the two kinds of polyesters (a2-1) and (a2-2) which are different in softening point from each other, the softening point of one polyester (a2-1) is preferably not lower than 70° C. and lower than 115° C., whereas the softening point of the other polyester (a2-2) is preferably not lower than 115° C. and not higher than 165° C. The mass ratio of the polyester (a2-1) to the polyester (a2-2) ((a2-1)/(a2-2)) is preferably from 10/90 to 90/10 and more preferably from 50/50 to 90/10.

Meanwhile, in the present invention, the crystalline polyester and the non-crystalline polyester may be respectively used in the form of a modified product thereof unless the effects of the present invention are adversely influenced. As the method of modifying the respective polyesters, there may be mentioned the method of grafting or blocking the polyester with phenol, urethane, epoxy, etc., by the methods described, for example, in JP 11-133668A, JP 10-239903A and JP 8-20636A, and the method of forming composite resins containing two or more kinds of resin units including a polyester unit, etc.

The total content of the crystalline polyester (a1) and the non-crystalline polyester (a2) in the resin particles (A) is preferably from 50 to 100% by mass, more preferably from 80 to 100% by mass, still more preferably from 90 to 100% by mass, and even still more preferably substantially 100% by mass, on the basis of the resins constituting the resin particles (A), from the viewpoints of a good low-temperature fusing property and a good anti-high-temperature offset property of the toner.

The mass ratio of the crystalline polyester (a1) to the non-crystalline polyester (a2) ((a1)/(a2)) in the resin particles (A) is preferably not less than 5/95, more preferably not less than 10/90, still more preferably not less than 13/87, and even still more preferably not less than 15/85, from the viewpoint of a good low-temperature fusing property of the toner, and is also preferably not more than 50/50, more preferably not more than 40/60, still more preferably not more than 30/70, even still more preferably not more than 25/75, and further even still more preferably not more than 20/80, from the viewpoints of a good storage stability of the toner.

The resin particles (A) may also contain a resin emulsion having an acid value of from 10 to 300 mgKOH/g, an oxazoline group-containing polymer, a releasing agent and an antistatic agent unless the effects of the present invention are adversely influenced. Further, the resin particles (A) may also contain other additives such as a reinforcing filler such as fibrous substances, an antioxidant and an anti-aging agent, if required. Of these materials, from the viewpoint of a good anti-high-temperature offset property of the toner, the resin particles (A) preferably contain the oxazoline group-containing polymer.

The oxazoline group-containing polymer is preferably the same oxazoline group-containing polymer as used in the step 1. From the viewpoint of a good anti-high-temperature offset property of the toner, the amount of the oxazoline group-containing polymer contained in the resin particles (A) is preferably not less than 0.05 part by mass, more preferably not less than 0.1 part by mass, and still more preferably not less than 0.5 part by mass, and is also preferably not more than 10 parts by mass, more preferably not more than 5 parts by mass, and still more preferably not more than 3 parts by mass, on the basis of 100 parts by mass of the resins constituting the rein particles (A).

The resin particles (A) may be in the form of particles constituted of a resin solely. However, from the viewpoint of obtaining a toner having a sharp particle size distribution, the resin particles (A) preferably contain a colorant, i.e., are preferably in the form of colorant-containing resin particles.

The content of the colorant in the resin particles (A) which are in the form of colorant-containing resin particles is preferably from 1 to 20 parts by mass and more preferably from 5 to 10 parts by mass on the basis of 100 parts by mass of the resins constituting the resin particles (A), from the viewpoint of a high image density of the toner.

(Colorant)

In the present invention, the colorant may be used in the form of a dispersion of colorant particles in an aqueous medium by a surface treatment or by using a dispersant. From the viewpoint of obtaining a toner having a sharp particle size distribution, the colorant is preferably incorporated into the resin particles (A).

The colorant may be either a pigment or a dye. From the viewpoint of a high image density of the toner, the pigment is preferably used.

Specific examples of the pigment include carbon blacks, inorganic composite oxides, Chrome Yellow, Benzidine Yellow, Brilliant Carmine 3B, Brilliant Carmine 6B, red iron oxide, Aniline Blue, ultramarine blue, copper phthalocyanine and Phthalocyanine Green. Among these pigments, preferred is copper phthalocyanine.

Specific examples of the dye include acridine dyes, azo dyes, benzoquinone dyes, azine dyes, anthraquinone dyes, indigo dyes, phthalocyanine dyes and Aniline Black dyes.

These colorants may be used alone or in combination of any two or more thereof.

(Production of Dispersion of Resin Particles (A))

The dispersion of the resin particles (A) is preferably produced by the method in which the crystalline polyester (a1), the non-crystalline polyester (a2) and the aforementioned optional components such as a colorant are dispersed in an aqueous medium to prepare a dispersion containing the resin particles (A).

As the method of obtaining the dispersion, there may be used the method of adding the resins and the like to the aqueous medium and subjecting the resulting mixture to dispersing treatment using a disperser, etc., the method of gradually adding the aqueous medium to the resins and the like to subject the resulting mixture to phase inversion of emulsion, etc. Among these methods, from the viewpoint of a good low-temperature fusing property of the obtained toner, the method using phase inversion of emulsion is preferred. In the following, the method using phase inversion of emulsion is explained.

First, the crystalline polyester (a1), the non-crystalline polyester (a2), an alkali aqueous solution and the aforementioned optional components such as a colorant are melted and mixed with each other to obtain a resin mixture.

Upon mixing these components, a surfactant is preferably added thereto from the viewpoint of a good emulsification stability of the resins.

Examples of the alkali contained in the alkali aqueous solution include hydroxides of alkali metals such as potassium hydroxide and sodium hydroxide, and ammonia. From the viewpoint of enhancing a dispersibility of the resins, among these alkalis, preferred are potassium hydroxide and sodium hydroxide. The concentration of the alkali in the alkali aqueous solution is preferably from 1 to 30% by mass, more preferably from 1 to 25% by mass and still more preferably from 1.5 to 20% by mass.

Examples of the surfactant include a nonionic surfactant, an anionic surfactant and a cationic surfactant. Among these surfactants, preferred is a nonionic surfactant. The nonionic surfactant is preferably used in combination with the anionic surfactant or the cationic surfactant. From the viewpoint of fully emulsifying the resins, the nonionic surfactant is more preferably used in combination with the anionic surfactant.

The content of the surfactants in the resin mixture is preferably not more than 20 parts by mass, more preferably not more than 15 parts by mass, still more preferably from 0.1 to 10 parts by mass, and even still more preferably from 0.5 to 10 parts by mass on the basis of 100 parts by mass of the resins constituting the resin particles (A).

As the method of producing the resin mixture, there is preferably used the method in which the crystalline polyester (a1), the non-crystalline polyester (a2), the alkali aqueous solution and the aforementioned optional components, preferably the surfactants, are charged into a vessel, and while stirring the contents of the vessel using a stirrer, the resins are melted and mixed with each other to prepare a uniform mixture.

The temperature used upon melting and mixing the resins is preferably not lower than a glass transition point of the non-crystalline polyester (a2), and more preferably not lower than a melting point of the crystalline polyester (a1) from the viewpoint of obtaining uniform resin particles.

Next, an aqueous medium is added to the resin mixture to subject the mixture to phase inversion, thereby obtaining a dispersion containing the resin particles (A).

The aqueous medium used herein preferably contains water as a main component. The content of water in the aqueous medium is preferably not less than 80% by mass, more preferably not less than 90% by mass, still more preferably not less than 95% by mass, and even still more preferably substantially 100% by mass. As the water, deionized water or distilled water is preferably used.

Examples of components other than water which may be contained in the aqueous medium include water-soluble organic solvents, e.g., aliphatic alcohols having 1 to 5 carbon atoms; dialkyl (C1 to C3) ketones such as acetone and methyl ethyl ketone; and cyclic ethers such as tetrahydrofuran.

The temperature used upon adding the aqueous medium is preferably not lower than a glass transition point of the non-crystalline polyester (a2), and more preferably not lower than a melting point of the crystalline polyester (a1) from the viewpoint of obtaining uniform resin particles.

From the viewpoint of reducing a particle size of the resin particles, the velocity of addition of the aqueous medium until terminating the phase inversion is preferably from 0.1 to 50 parts by mass/min, more preferably from 0.1 to 30 parts by mass/min, still more preferably from 0.5 to 10 parts by mass/min and even still more preferably from 0.5 to 5 parts by mass/min on the basis of 100 parts by mass of the resins constituting the resin particles (A). However, the velocity of addition of the aqueous medium after terminating the phase inversion is not particularly limited.

The aqueous medium is preferably used in an amount of from 100 to 2,000 parts by mass, more preferably from 150 to 1,500 parts by mass and still more preferably from 150 to 500 parts by mass on the basis of 100 parts by mass of the resins constituting the resin particles (A) from the viewpoint of obtaining uniform aggregated particles in the subsequent aggregating step. The solid content of the resulting dispersion of the resin particles is preferably from 7 to 50% by mass, more preferably from 10 to 40% by mass, still more preferably from 20 to 40% by mass and even still more preferably from 25 to 35% by mass from the viewpoints of a good stability of the dispersion of the resin particles and easiness of handling thereof. Meanwhile, the solid content means a total content of non-volatile components such as the resins and the surfactant.

The resulting dispersion of the rein particles (A) is preferably mixed with the aforementioned oxazoline group-containing polymer from the viewpoint of suppressing liberation of the wax from the carboxyl group-containing resin binder into the aqueous medium in the below-mentioned step 3.

The volume-median particle size of the resin particles (A) contained in the thus obtained dispersion of the resin particles (A) is preferably from 0.02 to 2 μm. From the viewpoint of obtaining a toner capable of forming a high quality image, the volume-median particle size of the resin particles (A) is more preferably from 0.02 to 1.5 μm, still more preferably from 0.05 to 1 μm and even still more preferably from 0.05 to 0.5 μm. Meanwhile, the volume-median particle size as used herein means a particle size at which a cumulative volume frequency calculated on the basis of a volume fraction of the particles from a smaller particle size side thereof is 50%.

The coefficient of variation (CV) (%) of a particle size distribution of the resin particles is preferably not more than 40%, more preferably not more than 35%, and still more preferably not more than 30% from the viewpoint of obtaining a toner capable of forming a high-quality image. The lower limit of CV is preferably not less than 5% from the viewpoint of a good productivity. Meanwhile, CV means the value represented by the following formula, and specifically is determined by the method described in Examples below.

$$CV\ (\%)=[\text{Standard Deviation of Particle Size Distribution}(\mu m)/\text{Volume-Average Particle Size}(\mu m)]\times 100.$$

[Resin Particles (B)]

The resin particles (B) used in the present invention preferably contain a non-crystalline polyester (b) from the viewpoints of a good low-temperature fusing property and a good anti-high-temperature offset property of the toner.

The preferred monomer composition and properties of the non-crystalline polyester (b) are the same as those of the aforementioned non-crystalline polyester (a2). The non-crystalline polyester (b) may be the same as or different from the non-crystalline polyester (a2).

The dispersion of the resin particles (B) is preferably inhibited from being mixed with the aforementioned oxazoline group-containing polymer from the viewpoint of a good tribocharge of the toner.

The non-crystalline polyester (b) may be used in combination of one or more kinds thereof, and preferably contains two kinds of polyesters that are different in softening point from each other from the viewpoints of a good low-temperature fusing property and a good anti-high-temperature offset property of the toner.

The resin particles (B) containing the non-crystalline polyester (b) may be produced by the same method as used for production of the aforementioned resin particles (A). The preferred volume-median particle size and coefficient of variation (CV) (%) of a particle size distribution of the resin particles (B) and the preferred concentration of solid components in the dispersion of the resin particles (B) are the same as those for the aforementioned resin particles (A).

<Step 2-1>

In the step (2-1), the water dispersion of the releasing agent particles obtained in the step 1 is mixed with a water dispersion of the resin particles (A) containing the carboxyl group-containing resin binder and optionally with an aggregating agent in an aqueous medium to obtain aggregated particles (1).

In the step 2-1, first, the resin particles (A) and the releasing agent particles are preferably mixed in the aqueous medium to obtain a mixed dispersion.

Meanwhile, in the step 2-1, a colorant is preferably mixed as an optional component. The colorant may be mixed as separate particles by itself or may be incorporated into the resin particles (A). From the viewpoint of well-controlled aggregation, the colorant is preferably incorporated into the resin particles (A).

Also, in the step 2-1, resin particles other than the resin particles (A) may be mixed.

The order of mixing of the respective materials is not particularly limited, and these materials may be added either sequentially or simultaneously.

The content of the resin particles (A) in the mixed dispersion on the basis of a solid content thereof is preferably from 10 to 40 parts by mass and more preferably from 10 to 20 parts by mass. The content of the aqueous medium in the mixed dispersion is preferably from 60 to 90 parts by mass and more preferably from 70 to 80 parts by mass.

Also, the content of the colorant in the mixed dispersion is preferably from 1 to 20 parts by mass and more preferably from 3 to 15 parts by mass on the basis of 100 parts by mass of the resins constituting the resin particles (A) from the viewpoint of a high image density.

The content of the releasing agent particles in the mixed dispersion on the basis of a solid content thereof is preferably from 1 to 20 parts by mass and more preferably from 2 to 15 parts by mass on the basis of 100 parts by mass of a total amount of solid components of the resin particles (A) from the viewpoints of a good releasing property and a good tribocharge of the toner.

The mixing temperature used in the step 2-1 is preferably from 0 to 40° C. from the viewpoint of well-controlled aggregation.

Next, the particles in the mixed dispersion are aggregated together to obtain a dispersion of the aggregated particles (1). The method of aggregating the particles is not particularly limited. For example, the particles may be aggregated together by the method of cooling the mixed dispersion, etc. In this case, an aggregating agent is preferably added to the mixed dispersion in order to efficiently conduct aggregation of the particles.

Examples of the aggregating agent used in the present invention include organic aggregating agents such as a cationic surfactant in the form of a quaternary salt and polyethyleneimine; and inorganic aggregating agents such as an inorganic metal salt, an inorganic ammonium salt and a divalent or higher-valent metal complex.

Specific examples of the inorganic metal salt include metal salts such as sodium sulfate, sodium chloride, calcium chloride and calcium nitrate; and inorganic metal salt polymers such as poly(aluminum chloride) and poly(aluminum hydroxide). Specific examples of the inorganic ammonium salt include ammonium sulfate, ammonium chloride and ammonium nitrate.

Of these inorganic ammonium salts, preferred is ammonium sulfate. The valence of the salt is not particularly limited, and the salt may be either monovalent salt or a divalent or higher-valent salt.

The amount of the aggregating agent used is preferably not more than 50 parts by mass, more preferably not more than 40 parts by mass and still more preferably not more than 30 parts by mass on the basis of 100 parts by mass of the resins constituting the resin particles (A) from the viewpoint of a good tribocharge of the toner, and also is preferably not less than 1 part by mass, more preferably not less than 3 parts by mass, still more preferably not less than 5 parts by mass, and even still more preferably not less than 15 parts by mass on the basis of 100 parts by mass of the resins constituting the resin particles (A) from the viewpoint of a good aggregating property of the resin particles. From these viewpoints, the amount of the monovalent salt used as the aggregating agent is preferably from 1 to 50 parts by mass, more preferably from 3 to 40 parts by mass, still more preferably from 5 to 30 parts by mass, and even still more preferably from 15 to 30 parts by mass on the basis of 100 parts by mass of the resins constituting the resin particles (A).

As the aggregating method, there may be used the method in which the aggregating agent, preferably an aqueous solution of the aggregating agent, is added dropwise into a vessel filled with the mixed dispersion. In this case, the aggregating agent may be added at one time, or intermittently or continuously. Upon and after adding the aggregating agent, the obtained dispersion is preferably fully stirred. The dropwise addition time of the aggregating agent is preferably from 1 to 120 min from the viewpoints of well-controlled aggregation and shortened production time of the toner, and the dropwise addition temperature thereof is preferably from 0 to 50° C. from the viewpoint of well-controlled aggregation. After completion of the dropwise addition of the aggregating agent, the resulting dispersion is preferably maintained at a temperature of from 30 to 70° C. and more preferably from 40 to 65° C. to enhance an efficiency of the aggregation.

From the viewpoint of reducing a particle size of the toner and suppressing occurrence of toner cloud within printers, the volume median particle size of the obtained aggregated particles (1) is preferably from 1 to 10 μm, more preferably from 2 to 9 μm and still more preferably from 3 to 6 μm, and CV of the aggregated particles (1) is preferably not more than 30%, more preferably not more than 28% and still more preferably not more than 25%. The lower limit of the volume median particle size of the aggregated particles (1) is preferably not less than 5% from the viewpoint of a good productivity.

<Step 2-2>

In the step 2-2, the resin particles (B) containing the non-crystalline polyester (b) are added to the aggregated particles (1) obtained in the step 2-1 to obtain aggregated particles (2).

In the step 2-2, it is preferred that a dispersion of the resin particles (B) containing the non-crystalline polyester (b) be added to a dispersion of the aggregated particles (1) obtained in the step 2-1 to allow the resin particles (B) to further adhere to the aggregated particles (1), thereby obtaining the aggregated particles (2).

Before adding the dispersion of the resin particles (B) to the dispersion of the aggregated particles (1), the dispersion of the aggregated particles (1) may be diluted by adding an aqueous medium thereto.

When the dispersion of the resin particles (B) is added to the dispersion of the aggregated particles (1), the aforementioned aggregating agent may be used in order to allow the resin particles (B) to efficiently adhere to the aggregated particles (1).

As the preferred method of adding the dispersion of the resin particles (B) to the dispersion of the aggregated particles (1), there may be mentioned the method in which the dispersion of the resin particles (B) is added to the dispersion of the aggregated particles (1) while maintaining the dispersion of the aggregated particles (1) at a temperature of preferably from 30 to 70° C. and more preferably from 40 to 65° C.

The temperature used in the reaction system of the step 2-2 is preferably lower by 5° C. or more than a melting point of the crystalline polyester (a1) contained in the resin particles (A), and also is preferably lower by 3° C. or more and more preferably lower by 5° C. or more than a glass transition point of the non-crystalline polyester (b), from the viewpoints of a good low-temperature fusing property and a good anti-high-temperature offset property of the toner. When producing the aggregated particles (2) in the aforementioned temperature range, the resulting toner can exhibit a good low-temperature fusing property and a good anti-high-temperature offset property. The reason therefor is considered as follows although it is not clearly determined. That is, it is considered that since no adhesion between the aggregated particles (2) occurs, formation of coarse particles can be prevented, and the crystallinity of the crystalline polyester (a1) can be maintained.

From the viewpoints of a good low-temperature fusing property and a good anti-high-temperature offset property of the toner, the amount of the resin particles (B) added is controlled such that the mass ratio of the resin particles (B) to the resin particles (A) [resin particles (B)/resin particles (A)] is preferably not less than 0.1, more preferably not less than 0.15, and still more preferably not less than 0.2, and is also preferably not more than 1.5, more preferably not more than 1, still more preferably not more than 0.75, and even still more preferably not more than 0.5, and thus is preferably from 0.1 to 1.5, more preferably from 0.15 to 1.0, still more preferably from 0.2 to 0.75, and even still more preferably from 0.2 to 0.5.

The dispersion of resin particles (B) may be added continuously over a predetermined period of time, or may be added at one time or split-added plural times. The dispersion of resin particles (B) is preferably added continuously over a predetermined period of time or split-added plural times. By adding the dispersion of resin particles (B) in the aforementioned manner, the resin particles (B) are likely to selectively adhere onto the aggregated particles (1). Among these addition methods, from the viewpoints of promoting selective adhesion of the resin particles (B) onto the aggregated particles (1) and efficiently producing the toner, the dispersion of resin particles (B) is preferably added continuously over a predetermined period of time. The time period of continuously adding the dispersion of resin particles (B) to the dispersion of the aggregated particles (1) is preferably from 1 to 10 h and more preferably from 3 to 8 h from the viewpoints of obtaining the uniform aggregated particles (2) and shortening a production time thereof.

The volume median particle size of the aggregated particles (2) obtained in the step 2-2 is preferably from 1 to 10 μm, more preferably from 2 to 10 μm, still more preferably from 3 to 9 μm and even still more preferably from 4 to 6 μm from the viewpoint of obtaining a toner capable of forming high-quality images.

The pH value of the aggregated particles (2) obtained in the step 2-2 is preferably from 5.5 to 7.5, more preferably from 6.0 to 7.0 and still more preferably from 6.0 to 6.5.

<Step 3>

In the step 3, the aggregated particles obtained in the step 2 are fused to obtain fused particles. In this step, the resin binder particles contained in the aggregated particles obtained in the step 2 are fused together. In the case where the step 2 includes the step 2-1 and the step 2-2, the aggregated particles (2) obtained in the step 2-2 are fused together to form core/shell particles.

In the case where the step 2 includes the step 2-1 and the step 2-2, from the viewpoints of promoting a fusibility of the aggregated particles and enhancing a productivity of the toner, in the step 3, the aggregated particles are maintained at a temperature that is preferably not lower than the glass transition point of the non-crystalline polyester (b), more preferably not lower than the temperature higher by 5° C. than the glass transition point of the non-crystalline polyester (b), and still more preferably not lower than the temperature higher by 10° C. than the glass transition point of the non-crystalline polyester (b). Further, from the viewpoints of maintaining a core/shell configuration of the toner and preventing liberation of the wax, in the step 3, the aggregated particles are maintained at a temperature that is preferably not higher than the temperature higher by 30° C. than the glass transition point of the non-crystalline polyester (b), more preferably not higher than the temperature higher by 25° C. than the glass transition point of the non-crystalline polyester (b), and still more preferably not higher than the temperature higher by 20° C. than the glass transition point of the non-crystalline polyester (b).

In the step 3, from the viewpoint of promoting fusion between the particles, the aggregated particles are preferably maintained at a temperature of from 65 to 90° C., more preferably from 70 to 90° C., and still more preferably from 70 to 85° C.

The retention time maintained in the step 3 is preferably from 30 s to 24 h, more preferably from 1 min to 10 h, and still more preferably from 4 min to 1 h, from the viewpoints of improving fusion between the particles, and enhancing a heat-resistant storage stability, a tribocharge and a productivity of the toner.

From the viewpoint of promoting fusion between the particles in the step 3, there may be suitably used an aggregation stopping agent. As the aggregation stopping agent, a surfactant is preferably used. The aggregation stopping agent is more preferably an anionic surfactant. Of the anionic surfactants, still more preferred is at least one anionic surfactant selected from the group consisting of alkylether sulfuric acid salts, alkyl sulfuric acid salts and straight-chain alkylbenzenesulfonic acid salts.

From the viewpoint of obtaining a high-quality image, the volume median particle size of the fused particles obtained in the step 3 is preferably from 2 to 10 μm, more preferably from 2 to 8 μm, still more preferably from 2 to 7 μm, even still more preferably from 3 to 8 μm and further even still more preferably from 4 to 6 μm.

Meanwhile, the average particle size of the fused particles obtained in the step 3 is preferably not larger than the average particle size of the aggregated particles. That is, in the step 3, the fused particles are preferably free from aggregation and adhesion therebetween.

In addition, the mass ratio of resins in a core portion of the core/shell particles obtained in the step 3 to resins in a shell portion of the core/shell particles (core/shell ratio) is preferably from 90/10 to 55/45, more preferably from 90/10 to 60/40, and still more preferably from 80/20 to 65/35.

In the present invention, the step 2 and the step 3 may be performed at the same time. More specifically, after adding the aggregating agent in the step 2-1, the reaction system may be slowly and gradually heated at a low temperature rise rate, so that it is possible to fuse the aggregated particles together while growing the particles. In the course of the heating, the resin particles (B) containing the non-crystalline polyester (b) as used in the step 2-2 may be added.

The temperature rise rate may vary depending upon amounts of the resins used, and is preferably from 0.01 to 2° C./min, more preferably from OA to 1° C./min, and still more preferably from 0.2 to 0.8° C./min.

The temperature to be finally reached upon the heating is preferably the aforementioned fusing temperature, more specifically, is preferably from 70 to 95° C. and more preferably from 75 to 90° C. Meanwhile, the temperature is preferably maintained until reaching the aforementioned average particle size of the fused particles.

In the case where the aggregating step and the fusing step are performed at the same time, it is preferable to use no aggregation stopping agent therein. By conducting the aforementioned steps, it is possible to reduce a circularity of the respective toner particles and produce the toner particles having an excellent cleaning property.

[Additional Treatment Step]

In the present invention, subsequent to completion of the step 3, the obtained dispersion may be subjected to an additional treatment step. In the additional treatment step, the resulting fused particles are preferably isolated from the dispersion to obtain the toner particles.

The fused particles obtained in the step 3 are present in the aqueous medium. Therefore, the dispersion is preferably first subjected to solid-liquid separation. The solid-liquid separation is preferably conducted by a suction filtration method, etc.

The particles obtained after the solid-liquid separation are preferably then rinsed.

Next, the obtained toner particles are preferably dried. The content of water in the particles obtained after drying is preferably adjusted to 1.5% by mass or less and more preferably 1.0% by mass or less from the viewpoint of suppressing occurrence of a toner cloud and enhancing a tribocharge of the toner.

[Toner for Electrophotography]

(Toner)

The toner particles obtained by subjecting the fused particles to drying, etc., may be directly used as a toner according to the present invention. However, the toner particles are preferably subjected to the below-mentioned surface treatment, and the thus surface-treated toner particles can be used as the toner for electrophotography according to the present invention.

The softening point of the thus obtained toner is preferably from 60 to 140° C., more preferably from 60 to 130° C. and still more preferably from 60 to 120° C. from the viewpoint of enhancing a low-temperature fusing property of the toner.

Also, the glass transition point of the toner is preferably from 20 to 70° C. and more preferably from 25 to 60° C. from the viewpoint of enhancing a low-temperature fusing property, a durability and a heat-resistant storage stability of the toner.

The volume median particle size of the toner is preferably from 1 to 10 μm, more preferably from 2 to 8 μm, still more preferably from 3 to 7 μm and even still more preferably from 4 to 6 μm, from the viewpoints of obtaining printed images having a high image quality and improving a productivity of the toner.

The CV of the toner is preferably not more than 30%, more preferably not more than 27%, and still more preferably not more than 25%, from the viewpoints of obtaining printed images having a high image quality and improving a productivity of the toner. The lower limit of the CV of the toner is preferably not less than 5% from the viewpoint of a good productivity of the toner.

The circularity of the respective toner particles is preferably not less than 0.950, more preferably not less than 0.960, and still more preferably not less than 0.970, from the viewpoint of obtaining fine printed images, and is also preferably not more than 0.995, more preferably not more than 0.993, and still more preferably not more than 0.992, from the viewpoints of suppressing occurrence of a toner cloud and enhancing a cleaning property of the toner. In addition, when attaching much importance to a cleaning property of the toner, the circularity of the respective toner particles is preferably not more than 0.970, more preferably not more than 0.965, and still more preferably not more than 0.960. The circularity of the respective toner particles is also preferably not less than 0.930 and more preferably not less than 0.940 from the viewpoint of a high productivity of the toner.

The circularity of the respective toner particles as used in the present invention means the value calculated from a ratio of a peripheral length of a circle having the same area as a projected area of the respective particles to a peripheral length of a projected image of the respective particles. As the shape of the particles is closer to a sphere, the circularity of the particles becomes closer to 1.

(External Additives)

The thus obtained toner particles may be directly used as the toner for electrophotography according to the present invention. However, the toner particles are preferably subjected to surface treatment with an external additive such as a fluidizing agent to add the additive onto a surface of the respective toner particles, and the resulting surface treated toner particles can be used as the toner for electrophotography according to the present invention.

Examples of the external additive include various fine particles, for example, inorganic fine particles such as hydrophobic silica fine particles, titanium oxide fine particles, alumina fine particles, cerium oxide fine particles and carbon blacks; and polymer fine particles such as fine particles of polycarbonates, polymethyl methacrylate, silicone resins, etc. Of these fine particles, preferred are hydrophobic silica fine particles.

When subjecting the toner particles to surface treatment with the external additive, the amount of the external additive added to the toner is preferably from 1 to 5 parts by mass, and more preferably from 2 to 4 parts by mass on the basis of 100 parts by mass of the toner particles.

The toner for electrophotography obtained according to the present invention can be used as one-component system developer, or can be mixed with a carrier to form a two-component system developer.

In the present specification, there are further described the following aspects concerning the process for producing a toner for electrophotography and the process for producing a water dispersion of releasing agent particles.

<1> A process for producing a toner for electrophotography, including the following steps 1 to 3:

Step 1: mixing and emulsifying a wax, a resin emulsion containing a resin having an acid value of from 10 to 300 mgKOH/g, and an oxazoline group-containing polymer with each other to obtain a water dispersion of releasing agent particles;

Step 2: mixing and aggregating the water dispersion of the releasing agent particles obtained in the step 1 with a water dispersion of resin particles containing a carboxyl group-containing resin binder to obtain aggregated particles; and Step 3: fusing the aggregated particles obtained in the step 2 to obtain fused particles.

<2> The process for producing a toner for electrophotography according to the above aspect <1>, wherein the wax is preferably a wax mixture containing a hydrocarbon wax and an ester wax.

<3> The process for producing a toner for electrophotography according to the above aspect <2>, wherein a melting point of the hydrocarbon wax is preferably not lower than 50° C., more preferably not lower than 60° C., and still more preferably not lower than 70° C., and is also preferably not higher than 100° C., more preferably not higher than 95° C., and still more preferably not higher than 90° C., and thus is preferably from 50 to 100° C., more preferably from 60 to 95° C., and still more preferably from 70 to 90° C.

<4> The process for producing a toner for electrophotography according to the above aspect <2> or <3>, wherein an acid value of the ester wax is preferably not less than 0.5 mgKOH/g, more preferably not less than 0.7 mgKOH/g, still more preferably not less than 1 mgKOH/g, and even still more preferably not less than 3 mgKOH/g, and is also preferably not more than 20 mgKOH/g, more preferably not more than 17 mgKOH/g, still more preferably not more than 15 mgKOH/g, and even still more preferably not more than 10 mgKOH/g, and thus is preferably from 0.5 to 20 mgKOH/g, more preferably from 0.7 to 17 mgKOH/g, and still more preferably from 1 to 15 mgKOH/g.

<5> The process for producing a toner for electrophotography according to any one of the above aspects <2> to <4>, wherein the ester wax is preferably a carnauba wax.

<6> The process for producing a toner for electrophotography according to any one of the above aspects <2> to <5>, wherein a melting point of the ester wax is preferably not lower than 50° C., more preferably not lower than 60° C., and still more preferably not lower than 70° C., and is also preferably not higher than 100° C., more preferably not higher than 95° C., and still more preferably not higher than 90° C., and thus is preferably from 50 to 100° C., more preferably from 60 to 95° C., and still more preferably from 70 to 90° C.

<7> The process for producing a toner for electrophotography according to any one of the above aspects <2> to <6>, wherein a mass ratio of the ester wax to the hydrocarbon wax as a mass ratio "ester wax/hydrocarbon wax" in the wax mixture is preferably not less than 5/95, more preferably not less than 10/90, and still more preferably not less than 20/80, and is also preferably not more than 70/30, more preferably not more than 50/50, still more preferably not more than 40/60, even still more preferably not more than 35/65, and further even still more preferably not more than 30/70, and thus is preferably from 5/95 to 70/30, more preferably from 10/90 to 50/50, still more preferably from 10/90 to 40/60, and even still more preferably from 20/80 to 30/70.

<8> The process for producing a toner for electrophotography according to any one of the above aspects <1> to <7>, wherein a content of an oxazoline group in the oxazoline group-containing polymer is preferably not less than 0.1 mmol/g, more preferably not less than 0.5 mmol/g, and still more preferably not less than 1 mmol/g, and is also preferably not more than 50 mmol/g, more preferably not more than 20 mmol/g, and still more preferably not more than 10 mmol/g, and thus is preferably from 0.1 to 50 mmol/g, more preferably from 0.5 to 20 mmol/g, and still more preferably from 1 to 10 mmol/g.

<9> The process for producing a toner for electrophotography according to any one of the above aspects <1> to <8>, wherein a number-average molecular weight of the oxazoline group-containing polymer is preferably not less than 500, and more preferably not less than 1,000, and is also preferably not more than 2,000,000, more preferably not more than 1,000,000, still more preferably not more than 100,000, and even still more preferably not more than 50,000, and thus is preferably from 500 to 2,000,000, and more preferably from 1,000 to 1,000,000.

<10> The process for producing a toner for electrophotography according to any one of the above aspects <1> to <9>, wherein an acid value of the resin contained in the resin emulsion is preferably not less than 15 mgKOH/g, more preferably not less than 50 mgKOH/g, and still more preferably not less than 100 mgKOH/g, and is also preferably not more than 270 mgKOH/g, more preferably not more than 250 mgKOH/g, and still more preferably not more than 200 mgKOH/g.

<11> The process for producing a toner for electrophotography according to any one of the above aspects <1> to <10>, wherein the resin emulsion is preferably at least one resin emulsion selected from the group consisting of a vinyl chloride-based resin emulsion, an acryl-based resin emulsion and a polyester resin emulsion, more preferably a vinyl chloride-based resin emulsion and/or an acryl-based resin emulsion, and still more preferably a vinyl chloride-based resin emulsion.

<12> The process for producing a toner for electrophotography according to any one of the above aspects <1> to <11>, wherein a content of the surfactant in the resin emulsion is preferably not more than 10% by mass, more preferably not more than 5% by mass, still more preferably not more than 3% by mass, and most preferably substantially 0% by mass on the basis of solid components contained in the resin emulsion.

<13> The process for producing a toner for electrophotography according to any one of the above aspects <1> to <12>, wherein a glass transition point of the resin contained in the resin emulsion is preferably not lower than 50° C., more preferably not lower than 55° C., and still more preferably not lower than 60° C., and is also preferably not higher than 90° C., more preferably not higher than 85° C., and still more preferably not higher than 80° C., and thus is preferably from 50 to 90° C., more preferably from 55 to 85° C., and still more preferably from 55 to 80° C.

<14> The process for producing a toner for electrophotography according to any one of the above aspects <1> to <13>, wherein a volume-median particle size of the resin emulsion is preferably from 0.01 to 0.5 μm, more preferably from 0.02 to 0.3 μm, and still more preferably from 0.03 to 0.2 μm.

<15> The process for producing a toner for electrophotography according to any one of the above aspects <1> to <14>, wherein a solid content (or a resin content) of the resin emulsion is preferably not less than 0.1 part by mass, more preferably not less than 0.5 part by mass, still more preferably not less than 1 part by mass, even still more preferably not less than 1.5 parts by mass, and further even still more preferably not less than 2 parts by mass, and is also preferably not more than 40 parts by mass, more preferably not more than 30 parts by mass, still more preferably not more than 15 parts by mass, even still more preferably not more than 10 parts by mass, and further even still more preferably not more than 8 parts by mass, and thus is preferably from 0.1 to 40 parts by mass, more preferably from 0.1 to 30 parts by mass, still more preferably from 0.1 to 15 parts by mass, even still more preferably from 0.5 to 10 parts by mass, further even still more preferably from 1 to 10 parts by mass, further even still more preferably from 1.5 to 8 parts by mass, and further even still more preferably from 2 to 8 parts by mass, on the basis of 100 parts by mass of a whole amount of the wax.

<16> The process for producing a toner for electrophotography according to any one of the above aspects <1> to <15>, wherein in the step 1, preferably after mixing the wax with the oxazoline group-containing polymer and then preferably stirring the resulting mixture, the resin emulsion is mixed and emulsified in the mixture to obtain a water dispersion of the releasing agent particles.

<17> The process for producing a toner for electrophotography according to the above aspect <16>, wherein a temperature used upon mixing the wax with the oxazoline group-containing polymer is preferably not lower than 50° C., more preferably not lower than 55° C., still more preferably not lower than 60° C., even still more preferably not lower than 70° C., and further even still more preferably not lower than 80° C., and is also preferably not higher than 120° C., more preferably not higher than 99° C., still more preferably not higher than 98° C., and even still more preferably not higher than 96° C., and thus is preferably from 50 to 120° C., more preferably from 55 to 99° C., still more preferably from 60 to 98° C., even still more preferably from 60 to 96° C., further even still more preferably from 70 to 96° C., and further even still more preferably from 80 to 96° C.

<18> The process for producing a toner for electrophotography according to any one of the above aspects <1> to <17>, wherein a molar ratio of the carboxyl group in the wax to the oxazoline group in the oxazoline group-containing polymer (carboxyl group/oxazoline group) is preferably not less than 0.01, more preferably not less than 0.02, and still more preferably not less than 0.05, and is also preferably not more than 3, more preferably not more than 2, and still more preferably not more than 1, and thus is preferably from 0.01 to 3, more preferably from 0.02 to 2, and still more preferably from 0.05 to 1.

<19> The process for producing a toner for electrophotography according to any one of the above aspects <1> to <18>, wherein a temperature used upon the emulsification in the step 1 is preferably not lower than 50° C., more preferably not lower than 55° C., still more preferably not lower than 60° C., even still more preferably not lower than 70° C., and further even still more preferably not lower than 80° C., and is also preferably not higher than 120° C., more preferably not higher than 99° C., still more preferably not higher than 98° C., and even still more preferably not higher than 96° C., and thus is preferably from 50 to 120° C., more preferably from 55 to 99° C., still more preferably 60 to 98° C., and even still more preferably from 60 to 96° C.

<20> The process for producing a toner for electrophotography according to any one of the above aspects <1> to <19>, wherein a molar ratio of the acid group in the resin emulsion to the oxazoline group in the oxazoline group-containing polymer (acid group/oxazoline group) is preferably not less than 0.05, more preferably not less than 0.1, still more preferably not less than 0.2, and even still more preferably not less than 0.5, and is also preferably not more than 10, more preferably not more than 8, and still more preferably not more than 5, and thus is preferably from 0.05 to 10, more preferably from 0.1 to 8, still more preferably from 0.2 to 5, and even still more preferably from 0.5 to 5.

<21> The process for producing a toner for electrophotography according to any one of the above aspects <1> to <20>, wherein a volume-median particle size ($D_{50}$) of the releasing agent particles which is to be controlled using an acid or an alkali in the step 1 is preferably not more than 1000 nm, more preferably not more than 900 nm, still more preferably not more than 800 nm, and even still more preferably not more than 700 nm, and is also preferably not less than 200 nm, more preferably not less than 300 nm, still more preferably not less than 400 nm, even still more preferably not less than 450 nm, and further even still more preferably not less than 500 nm, and thus is preferably from 200 to 900 nm, more preferably from 450 to 800 nm, and still more preferably from 500 to 700 nm.

<22> The process for producing a toner for electrophotography according to the above aspect <21>, wherein a pH value of the water dispersion of the releasing agent particles as measured at 20° C. is preferably not less than 6.0, more preferably not less than 6.5, and still more preferably not less than 7.0, and is also preferably not more than 11.0, more preferably not more than 10.5, and still more preferably not more than 10.0, and thus is preferably from 6.0 to 11.0, more preferably from 6.5 to 10.5, and still more preferably from 7.0 to 10.0.

<23> The process for producing a toner for electrophotography according to any one of the above aspects <1> to <22>, wherein a concentration of solid components in the water dispersion of the releasing agent particles obtained in the step 1 is preferably not less than 5% by mass, more preferably not less than 10% by mass, and still more preferably not less than 15% by mass, and is also preferably not more than 60% by mass, more preferably not more than 50% by mass, and still more preferably not more than 30% by mass, and thus is preferably from 5 to 60% by mass, more preferably from 10 to 50% by mass, and still more preferably from 15 to 50% by mass.

<24> The process for producing a toner for electrophotography according to any one of the above aspects <1> to <23>, wherein a volume-median particle size ($D_{50}$) of the releasing agent particles obtained in the step 1 is preferably not more than 1000 nm, more preferably not more than 900 nm, still more preferably not more than 800 nm, and even still more preferably not more than 700 nm, and is also preferably not less than 200 nm, more preferably not less than 300 nm, still more preferably not less than 400 nm, even still more preferably not less than 450 nm, and further even still more preferably not less than 500 nm.

<25> The process for producing a toner for electrophotography according to any one of the above aspects <1> to <24>, wherein the step 2 preferably includes the following step 2-1, and more preferably includes the following steps 2-1 and 2-2:

Step 2-1: mixing the water dispersion of the releasing agent particles obtained in the step 1 with a water dispersion of resin particles (A) containing a carboxyl group-containing resin binder and an aggregating agent in an aqueous medium to obtain aggregated particles (1); and Step 2-2: adding a water dispersion of resin particles (B) containing a non-crystalline polyester (b) to the aggregated particles (1) obtained in the step 2-1 to obtain aggregated particles (2).

<26> The process for producing a toner for electrophotography according to any one of the above aspects <1> to <25>, wherein the resin particles containing the carboxyl group-containing resin binder or the resin particles (A)

containing the carboxyl group-containing resin binder preferably contain at least one resin selected from the group consisting of a crystalline polyester (a1) and a non-crystalline polyester (a2).

<27> The process for producing a toner for electrophotography according to the above aspect <26>, wherein the crystalline polyester (a1) is preferably obtained by polycondensing an alcohol component containing an α,ω-alkanediol having 10 to 12 carbon atoms and an acid component containing an aliphatic dicarboxylic acid.

<28> The process for producing a toner for electrophotography according to the above aspect <26> or <27>, wherein a softening point of the crystalline polyester (a1) is preferably not lower than 50° C., more preferably not lower than 60° C., still more preferably not lower than 65° C., and even still more preferably not lower than 70° C., and is also preferably not higher than 140° C., more preferably not higher than 120° C., still more preferably not higher than 110° C., and even still more preferably not higher than 100° C., and thus is preferably from 50 to 140° C., more preferably from 60 to 120° C., still more preferably from 65 to 110° C., and even still more preferably from 70 to 100° C.

<29> The process for producing a toner for electrophotography according to any one of the above aspects <26> to <28>, wherein an acid value of the crystalline polyester (a1) is preferably not less than 3 mgKOH/g, more preferably not less than 4 mgKOH/g, still more preferably not less than 5 mgKOH/g, and even still more preferably not less than 6 mgKOH/g, and is also preferably not more than 30 mgKOH/g, more preferably not more than 25 mgKOH/g, still more preferably not more than 23 mgKOH/g, and even still more preferably not more than 20 mgKOH/g, and thus is preferably from 3 to 30 mgKOH/g, more preferably from 4 to 25 mgKOH/g, still more preferably from 5 to 23 mgKOH/g, and even still more preferably from 6 to 20 mgKOH/g.

<30> The process for producing a toner for electrophotography according to any one of the above aspects <26> to <29>, wherein a glass transition point of the non-crystalline polyester (a2) is preferably not lower than 50° C., and more preferably not lower than 55° C., and is also preferably not higher than 85° C., more preferably not higher than 75° C., and still more preferably not higher than 70° C., and thus is preferably from 50 to 85° C., more preferably from 55 to 75° C., and still more preferably from 55 to 70° C.

<31> The process for producing a toner for electrophotography according to any one of the above aspects <26> to <30>, wherein a softening point of the non-crystalline polyester (a2) is preferably not lower than 70° C., more preferably not lower than 90° C., and still more preferably not lower than 100° C., and is also preferably not higher than 165° C., more preferably not higher than 140° C., and still more preferably not higher than 130° C., and thus is preferably from 70 to 165° C., more preferably from 90 to 140° C., and still more preferably from 100 to 130° C.

<32> The process for producing a toner for electrophotography according to any one of the above aspects <26> to <31>, wherein a number-average molecular weight of the non-crystalline polyester (a2) is preferably from 1,000 to 100,000, more preferably from 1,500 to 60,000, still more preferably from 1,600 to 30,000, and even still more preferably from 1,700 to 10,000.

<33> The process for producing a toner for electrophotography according to any one of the above aspects <26> to <32>, wherein an acid value of the non-crystalline polyester (a2) is preferably not less than 6 mgKOH/g, more preferably not less than 10 mgKOH/g, and still more preferably not less than 15 mgKOH/g, and is also preferably not more than 35 mgKOH/g, and more preferably not more than 30 mgKOH/g, and thus is preferably from 6 to 35 mgKOH/g, more preferably from 10 to 30 mgKOH/g, and still more preferably from 15 to 30 mgKOH/g.

<34> The process for producing a toner for electrophotography according to any one of the above aspects <26> to <33>, wherein a mass ratio of the crystalline polyester (a1) to the non-crystalline polyester (a2) ((a1)/(a2)) in the resin particles (A) is preferably not less than 5/95, more preferably not less than 10/90, still more preferably not less than 13/87, and even still more preferably not less than 15/85, and is also preferably not more than 50/50, more preferably not more than 40/60, still more preferably not more than 30/70, even still more preferably not more than 25/75, and further even still more preferably not more than 20/80, and thus is preferably from 5/95 to 50/50, more preferably from 10/90 to 40/60, still more preferably from 13/87 to 30/70, even still more preferably from 15/85 to 25/75, and further even still more preferably from 15/85 to 20/80.

<35> The process for producing a toner for electrophotography according to any one of the above aspects <1> to <34>, wherein the resin particles (A) containing the carboxyl group-containing resin binder preferably contain the oxazoline group-containing polymer, and a content of the oxazoline group-containing polymer in the resin particles (A) is preferably not less than 0.05 part by mass, more preferably not less than 0.1 part by mass, and still more preferably not less than 0.5 part by mass, and is also preferably not more than 10 parts by mass, more preferably not more than 5 parts by mass, and still more preferably not more than 3 parts by mass, on the basis of 100 parts by mass of the resins constituting the rein particles (A).

<36> The process for producing a toner for electrophotography according to any one of the above aspects <1> to <35>, wherein the resin emulsion is preferably a carboxyl group-containing resin emulsion.

<37> The process for producing a toner for electrophotography according to any one of the above aspects <1> to <36>, wherein a mass ratio of the resin particles (B) to the resin particles (A) [resin particles (B)/resin particles (A)] is preferably not less than 0.1, more preferably not less than 0.15, still more preferably not less than 0.2, and is also preferably not more than 1, more preferably not more than 0.75, and still more preferably not more than 0.5, and thus is preferably from 0.1 to 1.5, more preferably from 0.15 to 1.0, still more preferably from 0.2 to 0.75, and even still more preferably from 0.2 to 0.5.

<38> The process for producing a toner for electrophotography according to any one of the above aspects <1> to <37>, wherein the step 2 and the step 3 are performed at the same time.

<39> The process for producing a toner for electrophotography according to the above aspect <38>, wherein no aggregation stopping agent is used.

<40> A process for producing a water dispersion of releasing agent particles used in a toner for electrophotography, including the following step 1:

Step 1: mixing and emulsifying a wax, a resin emulsion containing a resin having an acid value of from 10 to 300 mgKOH/g, and an oxazoline group-containing polymer with each other to obtain a water dispersion of releasing agent particles.

<41> A water dispersion of releasing agent particles produced by the process according to the above aspect <40>.

EXAMPLES

Respective properties of various components, rein particles, toners, etc., were measured and evaluated by the following methods.

[Average Molecular Weight]

The average molecular weight of a resin was calculated from a molecular weight distribution thereof measured by gel permeation chromatography according to the following method.

<1> Preparation of Sample Solution

A polyester sample was dissolved in a solvent (chloroform) to prepare a solution of the polyester having a concentration of 0.5 g/100 mL. The resultant solution was then filtered through a fluororesin filter "DISMIC-25JP" available from ADVANTEC having a mesh size of 0.45 μm to remove insoluble components therefrom, thereby preparing a sample solution.

<2> Measurement of Molecular Weight Distribution

Using the below-mentioned apparatus, a solvent (chloroform) was allowed to flow through a column at a flow rate of 1 mL/min, and the column was stabilized in a thermostat at 40° C. One hundred microliters of the sample solution were injected into the column to measure a molecular weight distribution of the sample. The molecular weight of the sample was calculated on the basis of a calibration curve previously prepared. The calibration curve of the molecular weight was prepared by using several kinds of monodisperse polystyrenes (those monodisperse polystyrenes having molecular weights of $2.63\times10^3$, $2.06\times10^4$ and $1.02\times10^5$ available from Tosoh Corporation; and those monodisperse polystyrenes having molecular weights of $2.10\times10^3$, $7.00\times10^3$ and $5.04\times10^4$ available from GL Science Inc.) as standard samples.

Analyzer: "HLC-8220 GPC" available from Tosoh Corporation

Column: "$GMH_{XL}$"+"$G3000H_{XL}$" both available from Tosoh Corporation

[Method of Measuring Average Molecular Weight of Oxazoline Group-Containing Polymer]

The average molecular weight of the oxazoline group-containing polymer was exceptionally measured by the following method. That is, using the below-mentioned apparatus, an eluent constituted of 60 mM $H_3PO4$ and 50 mM LiBr/guaranteed reagent DMF was allowed to flow through a column at a flow rate of 1 mL/min, and the column was stabilized in a thermostat at 40° C. One hundred microliters of a 5 mg/mL sample solution were injected into the column to measure a molecular weight distribution of the sample. The molecular weight of the sample was calculated on the basis of a calibration curve previously prepared. The calibration curve of the molecular weight was prepared by using several kinds of monodisperse polystyrenes (those monodisperse polystyrenes having molecular weights of $2.63\times10^3$, $2.06\times10^4$ and $1.02\times10^5$ available from Tosoh Corporation; and those monodisperse polystyrenes having molecular weights of $2.10\times10^3$, $7.00\times10^3$ and $5.04\times10^4$ available from GL Science Inc.) as standard samples.

Analyzer: "CO-8010" available from Tosoh Corporation

Column: "α-M"+"α-M" available from Tosoh Corporation

[Acid Values of Resin and Wax]

Measured by the same method as prescribed in JIS K0070-1992 except that chloroform was used as a solvent for the measurement.

[Softening Point, Crystallinity Index, Melting Point and Glass Transition Point of Polyester]

(1) Softening Point

Using a flow tester "CFT-500D" (tradename) available from Shimadzu Corporation, 1 g of a sample was extruded through a nozzle having a die pore diameter of 1 mm and a length of 1 mm while heating the sample at a temperature rise rate of 6° C./min and applying a load of 1.96 MPa thereto by a plunger. The softening point was determined as the temperature at which a half amount of the sample was flowed out when plotting a downward movement of the plunger of the flow tester relative to the temperature.

(2) Crystallinity Index

Using a differential scanning calorimeter "Q100" (tradename) available from TA Instruments Japan Inc., a sample was cooled from room temperature (20° C.) to 0° C. at a temperature drop rate of 10° C./min and allowed to stand as such under the conditions for 1 min, and then heated to 180° C. at a temperature rise rate of 10° C./min to prepare an endothermic characteristic curve thereof. Among the endothermic peaks observed in the characteristic curve, the temperature of the peak having a largest peak area was regarded as an endothermic maximum peak temperature (1). The crystallinity index of the sample was calculated from the following formula:

Crystallinity Index=(Softening Point(° C.)/(Endothermic Maximum Peak Temperature(1)(° C.))

(3) Melting Point and Glass Transition Point

Using a differential scanning calorimeter "Q100" (tradename) available from TA Instruments Japan Inc., a sample was heated to 200° C. and then cooled from 200° C. to 0° C. at a temperature drop rate of 10° C./min, and successively heated to 200° C. at temperature rise rate of 10° C./min to prepare an endothermic characteristic curve thereof. Among the endothermic peaks observed in the characteristic curve, the temperature of the peak having a largest peak area was regarded as an endothermic maximum peak temperature (2). In the case of a crystalline polyester, the peak temperature was regarded as a melting point thereof. Also, in the case of a non-crystalline polyester, if any endothermic peak was observed in the characteristic curve thereof, the endothermic peak temperature observed was regarded as a glass transition point thereof. Whereas, when a shift of the characteristic curve was observed without any peaks, the temperature at which a tangential line having a maximum inclination of the curve in the portion of the curve shift was intersected with an extension of the baseline on the high-temperature side of the curve shift was read as the glass transition point.

[Volume Median Particle Size ($D_{50}$) and Particle Size Distribution of Aggregated Particles]

The volume median particle size of the aggregated particles was measured as follows.

Measuring Apparatus: "Coulter Multisizer III" (tradename) commercially available from Beckman Coulter Inc.

Aperture Diameter: 50 μm

Analyzing Software: "Multisizer III Ver. 3.51" (tradename) commercially available from Beckman Coulter Inc.

Electrolyte Solution: "Isotone II" (tradename) commercially available from Beckman Coulter Inc.

Measuring Conditions:

The thus prepared sample dispersion containing the aggregated particles was added to 100 mL of the electrolyte solution, and after controlling a concentration of the resultant dispersion so as to complete measurement for particle sizes of 30,000 particles within 20 s, the particle sizes of the 30,000 particles in the dispersion were measured under such a condition, and a volume median particle size ($D_{50}$) thereof was determined from the particle size distribution.

Also, CV (%) as the particle size distribution was calculated according to the following formula:

CV (%)=(Standard Deviation of Particle Size Distribution/Volume Median Particle Size($D_{50}$))×100.

[Volume Median Particle Size ($D_{50}$) and Content of Finer Powders (Fines Content) of Toner (Particles)]

The volume median particle size of the toner (particles) was measured as follows.

The same measuring apparatus, aperture diameter, analyzing software and electrolyte solution as used for measuring the volume median particle size of the aggregated particles were used.

Dispersing Solution:

A polyoxyethylene lauryl ether "EMALGEN 109P" (tradename) (HLB: 13.6) commercially available from Kao Corporation was dissolved in the above electrolyte solution to prepare a dispersion having a concentration of 5% by mass.

Dispersing Conditions:

Ten milligrams of a toner sample to be measured were added to 5 mL of the dispersing solution, and dispersed using an ultrasonic disperser for 1 min. Thereafter, 25 mL of the electrolyte solution were added to the resulting dispersion, and the obtained mixture was further dispersed using the ultrasonic disperser for 1 min to prepare a sample dispersion.

Measuring Conditions:

The thus prepared sample dispersion was added to 100 mL of the electrolyte solution, and after controlling a concentration of the resultant dispersion so as to complete measurement for particle sizes of 30,000 particles within 20 s, the particle sizes of the 30,000 particles in the dispersion were measured under such a condition, and a volume median particle size ($D_{50}$) thereof was determined from the particle size distribution. Furthermore, the particle size distribution was converted into a number-based distribution thereof, and a ratio of the number of the particles having a particle size of 2 μm or less to the number of the whole particles was defined as a content of fine powders in the toner.

[Volume Median Particle Size ($D_{50}$) and Particle Size Distribution of Resin Particles and Releasing Agent Particles]

(1) Measuring Apparatus: Laser diffraction particle size analyzer "LA-920" (tradename) commercially available from HORIBA Ltd.

(2) Measuring Conditions: In a cell for the measurement which was filled with distilled water, a volume median particle size ($D_{50}$) of the particles was measured at a concentration at which an absorbance thereof was present within an adequate range. Also, the CV of the particles was calculated according to the following formula:

CV (%)=(Standard Deviation of Particle Size Distribution/Volume Median Particle Size)×100.

[Concentration of Solid Components in Dispersion of Resin Particles and Dispersion of Releasing Agent Particles]

Using an infrared moisture meter "FD-230" (tradename) available from Kett Electric Laboratory, 5 g of a sample to be measured were subjected to measurement of a water content (%) thereof at a drying temperature of 150° C. under a measuring mode 96 (monitoring time: 2.5 min/variation range: 0.05%). The concentration of solid components in the sample was calculated according to the following formula:

Solid concentration(mass %)=100−M wherein M is a water content (%) which is represented by the formula: $[(W-W_0)/W]\times100$ wherein W is a mass of the sample before the measurement (initial mass of the sample); and $W_0$ is a mass of the sample after the measurement (absolute dry mass).

[Circularity of Toner]

The dispersion of a toner was prepared as follows. That is, 50 mg of the toner were added to 5 mL of a 5% by mass aqueous solution of polyoxyethylene lauryl ether "EMALGEN 109P", and the resulting dispersion was dispersed using an ultrasonic disperser for 1 min. Thereafter, 20 mL of distilled water were added to the resulting dispersion, and the obtained mixture was further dispersed using the ultrasonic disperser for 1 min to prepare the dispersion of the toner.

Measuring Apparatus: Flow-type particle image analyzer "FPIA-3000" (tradename) available from Sysmex Corporation Measuring Mode: HPF measuring mode

[Fusing Region of Toner; Low-Temperature Fusing Temperature to High-Temperature Offset Temperature]

A solid image was outputted and printed on a wood-free paper "J Paper" available from Fuji Xerox Co., Ltd.; size: A4 using a commercially available printer "Microline 5400" (tradename) available from Oki Data Corporation. The solid image thus outputted was an unfused solid image having a length of 50 mm which was printed on the above A4 paper except for its top margin of the A4 paper extending 5 mm from a top end thereof such that an amount of the toner deposited on the paper was from 0.42 to 0.48 mg/cm$^2$.

Next, the thus obtained unfused solid image on the paper was fused by passing the paper through a fuser mounted to the same printer as used above which was however modified so as to variably control its fusing temperature. Upon fusing the image, the temperature of the fuser was adjusted to 90° C., and the fusing rate thereof was adjusted to 1.2 s per sheet in a longitudinal direction of the A4 paper, thereby obtaining a printed paper.

In addition, the same fusing procedure was conducted while increasing the fusing temperature at intervals of 5° C., thereby obtaining printed papers.

A mending tape ("Scotch Mending Tape 810" (tradename) available from 3M; width: 18 mm) was cut into a length of 50 mm and lightly attached to a top margin above an upper end of the solid image on the respective printed papers. Then, a weight of 500 g was rested on the tape and reciprocated by one stroke over the tape at a speed of 10 mm/s while press-contacting with the tape. Thereafter, the attached tape was peeled off from its lower end side at a peel angle of 180° and a peel speed of 10 mm/s, thereby obtaining the printed papers from which the tape had been peeled off. At each time before attaching the tape to the printed paper and after peeling-off the tape therefrom, the printed paper was placed on 30 sheets of a wood-free paper "EXCELLENT WHITE PAPER" (size; A4) available from Oki Data Corporation to measure a reflection image density of the fused image portion thereof using a colorimeter "SpectroEye" (tradename) available from GretagMacbeth under the light irradiating conditions including a standard light source $D_{50}$, an observation visual field of 2°, and a density standard DINNB based on an absolute white color. The fusing rate of the toner was calculated from the thus measured reflection image densities according to the following formula.

Fusing Rate=(Reflection image density after peeling-off the tape/Reflection image density before attaching the tape)×100

The temperature at which the fusing rate first reached 90% or higher was defined as a minimum fusing temperature. The lower the minimum fusing temperature, the more excellent the low-temperature fusing property of the toner becomes.

Also, the fusing temperature was further raised to determine a high-temperature fusing region of the toner by the same method as used above. The temperature at which the fusing rate was reduced to less than 90% was defined as a high offset temperature of the toner. The higher the high offset temperature, the wider the high-temperature fusing region of the toner becomes.

[Heat-Resistant Storage Stability of Toner]

A 100-mL polymer bottle having a diameter of 3 cm was charged with 20 g of the toner and hermetically sealed, and stored in the sealed state at 55° C. for 8 h. Thereafter, a 355 μm-mesh sieve was fitted to a vibrating table of a powder tester available from Hosokawa Micron Co., Ltd., and the toner sample stored was placed on the sieve and vibrated for 10 s to measure a mass of the toner as a residue on the sieve which was defined as a blocking amount of the toner.

The heat-resistant storage stability of the toner was evaluated as follows. That is, the lower the extent of aggregation of the toner and the smaller the blocking amount of the toner, the more excellent the heat-resistant storage stability of the toner becomes.

[Condition of Liberation of Wax in Fusing Step]

Five grams of a dispersion of fused particles were sampled in a centrifuge tube and subjected to centrifugal separation using a centrifugal separator "CN-2060" (tradename) available from HSIANGTAI Machinery Industry Co., Ltd., at 4000 rpm for 1 min to precipitate the fused particles therefrom and observe a supernatant solution by naked eyes.

The condition that the supernatant solution was colorless and transparent showed that no wax was liberated, whereas the condition that the supernatant solution was whitely turbid showed that the wax was liberated. The higher the extent of white turbidity of the supernatant solution, the larger the amount of the wax liberated becomes.

[Extent of Exposure of Wax to Surface of Toner]

The toner sample was observed by an electron microscope. In an electron micrograph of the toner sample, optional 10 particles of the toner were selected, and the number of the releasing agent particles observed in one field of view of the electron micrograph was counted to determine the number of the releasing agent particles that were present per a surface of one toner particle as an average number thereof.

In the case where the number of the releasing agent particles observed per a surface of one toner particle was less than 1, the extent of exposure of the wax was regarded as being "very small".

In the case where the number of the releasing agent particles observed per a surface of one toner particle was not less than 1 and less than 3, the extent of exposure of the wax was regarded as being "small".

In the case where the number of the releasing agent particles observed per a surface of one toner particle was not less than 3 and less than 5, the extent of exposure of the wax was regarded as being "slightly large".

In the case where the number of the releasing agent particles observed per a surface of one toner particle was not less than 5, the extent of exposure of the wax was regarded as being "large".

[Evaluation of Tribocharge of Toner]

A 50-cc cylindrical polypropylene bottle available from Nikko Hansen & Co., Ltd., was charged with 2.1 g of a toner and 27.9 g of a silicone ferrite carrier (average particle size: 40 μm) available from Kanto Denka Kogyo Co., Ltd., and the contents of the bottle were manually shaken and stirred 10 times in each of vertical and horizontal directions to prepare a developer. The thus prepared developer was allowed to stand under NN environmental conditions (25° C.; 50% RH) and maintained under the conditions for 12 h. Thereafter, the developer was stirred by a tumbler mixer for 10 min to measure a tribocharge of the toner using a q/m-meter available from Epping GmbH. The tribocharge thus measured was defined as a tribocharge of the toner under NN environmental conditions.

Measuring Device: q/m-meter available from Epping GmbH

Measuring Conditions Set: mesh size: 635 meshes (opening: 24 μm;

stainless steel screen); soft blow, blow pressure (600 V)

Suction Time: 90 s $$\text{Tribocharge}(\mu C/g)=(\text{Total Electricity}(\mu C)\text{ after 90 s})/(\text{Amount}(g)\text{ of Toner Sucked})$$

The larger the tribocharge, the more excellent the charging performance of the toner and the clearer the image obtained upon printing become. In addition, the larger the amount of the wax present on the surface of the toner particles, the less the tribocharge of the toner becomes.

[Evaluation of Cleaning Property of Toner]

A silicone-coated ferrite carrier having an average particle size of 60 μm available from Kanto Denka Kogyo Co., Ltd., was added to the obtained cyan toner to prepare a developer having a toner concentration [(mass of toner)/(total mass of toner and carrier)] of 5.0% by mass. Using the thus prepared developer, images were printed on 50 sheets using a laser printer "IPSIO NX85S" available from Ricoh Company Ltd., and the printed surface of the respective sheets was observed by naked eyes to evaluate a cleaning property of the toner.

A: No cleaning defects occurred even after the images were printed on 50 sheets.

B: Cleaning defects occurred when the images were printed on 30 to 49 sheets.

C: Cleaning defects occurred when the images were printed on less than 30 sheets.

[Production of Polyesters]

Production Example 1

Production of Crystalline Polyester (A)

An inside atmosphere of a four-necked flask equipped with a nitrogen inlet tube, a dehydration tube, a stirrer and a thermocouple was replaced with nitrogen, and 5050 g of 1,12-dodecanediol as an alcohol component and 2950 g of succinic acid as an acid component were charged into the flask. The contents of the flask were heated to 135° C. while stirring and maintained at 135° C. for 3 h, and then heated from 135° C. to 200° C. over 10 h. Thereafter, 16 g of tin di(2-ethylhexanoate) were added to the flask, and the contents of the flask were further maintained at 200° C. for 1 h, and then the pressure within the flask was reduced and maintained under 8.3 kPa for 1 h, thereby obtaining a crystalline polyester (A). As a result, it was confirmed that the thus obtained crystalline polyester (A) had a softening point of 87° C., a melting point of 79° C., a crystallinity index of 1.1, an acid value of 8.2 mgKOH/g and a number-average molecular weight of 1,500.

Production Example 2

Production of Non-Crystalline Polyester (B)

An inside atmosphere of a four-necked flask equipped with a nitrogen inlet tube, a dehydration tube, a stirrer and a thermocouple was replaced with nitrogen, and 1750 g of polyoxypropylene (2.2)-2,2-bis(4-hydroxyphenyl)propane, 1625 g of polyoxyethylene (2.0)-2,2-bis(4-hydroxyphenyl) propane, 1145 g of terephthalic acid, 161 g of dodecenyl-succinic anhydride, 480 g of trimellitic anhydride and 10 g of dibutyl tin oxide were charged into the flask. The contents of the flask were heated to 220° C. in a nitrogen atmosphere while stirring and maintained at 220° C. for 5 h. Thereafter, after confirming that the softening point of the contents of the flask reached 120° C. as measured according to ASTM D36-86, the temperature of the contents of the flask was dropped to terminate a reaction thereof, thereby obtaining a non-crystalline polyester (B). As a result, it was confirmed that the thus obtained non-crystalline polyester (B) had a glass transition point of 64° C., a softening point of 122° C., a crystallinity index of 1.6, an acid value of 21.0 mgKOH/g and a number-average molecular weight of 2,700.

Production Example 3

Production of Non-Crystalline Polyester (C)

An inside atmosphere of a four-necked flask equipped with a nitrogen inlet tube, a dehydration tube, a stirrer and a thermocouple was replaced with nitrogen, and 3374 g of polyoxypropylene (2.2)-2,2-bis(4-hydroxyphenyl)propane, 33 g of polyoxyethylene (2.0)-2,2-bis(4-hydroxyphenyl) propane, 672 g of terephthalic acid and 10 g of dibutyl tin oxide were charged into the flask. The contents of the flask were heated to 230° C. in a nitrogen atmosphere while stirring and maintained at 230° C. for 5 h, and then the pressure within the flask was reduced and maintained under 8.3 kPa for 1 h. Thereafter, the contents of the flask were cooled to 210° C., and after returning the pressure within the flask to atmospheric pressure, 696 g of fumaric acid and 0.49 g of tert-butyl catechol were added to the flask. The contents of the flask were maintained at 210° C. for 5 h, and then the pressure within the flask was further reduced and maintained under 8.3 kPa for 4 h, thereby obtaining a non-crystalline polyester (C). As a result, it was confirmed that the thus obtained non-crystalline polyester (C) had a glass transition point of 65° C., a softening point of 107° C., a crystallinity index of 1.5, an acid value of 24.4 mgKOH/g and a number-average molecular weight of 2,500.

Production Example 4

Production of Non-Crystalline Polyester (D)

An inside atmosphere of a four-necked flask equipped with a nitrogen inlet tube, a dehydration tube, a stirrer and a thermocouple was replaced with nitrogen, and 3004 g of polyoxypropylene (2.2)-2,2-bis(4-hydroxyphenyl)propane, 996 g of fumaric acid, 2 g of tert-butyl catechol and 8 g of dibutyl tin oxide were charged into the flask. The contents of the flask were heated to 210° C. over 5 h in a nitrogen atmosphere while stirring and maintained at 210° C. for 2 h. Thereafter, the contents of the flask were reacted under 8.3 kPa until reaching the below-mentioned softening point, thereby obtaining a non-crystalline polyester (D). As a result, it was confirmed that the thus obtained non-crystalline polyester (D) had a glass transition point of 57° C., a softening point of 101° C., a crystallinity index of 1.5, an acid value of 22.4 mgKOH/g and a number-average molecular weight of 2,500.

Production Example 5

Production of Non-Crystalline Polyester (E)

An inside atmosphere of a four-necked flask equipped with a nitrogen inlet tube, a dehydration tube, a stirrer and a thermocouple was replaced with nitrogen, and 3528 g of polyoxypropylene (2.2)-2,2-bis(4-hydroxyphenyl)propane, 1404 g of polyoxyethylene (2.0)-2,2-bis(4-hydroxyphenyl) propane, 1248 g of terephthalic acid, 1541 g of dodecenyl-succinic anhydride and 20 g of dibutyl tin oxide were charged into the flask. The contents of the flask were heated to 230° C. in a nitrogen atmosphere while stirring and maintained at 230° C. for 6 h, and then the pressure within the flask was reduced and maintained under 8.3 kPa for 1 h. Thereafter, the contents of the flask were cooled to 215° C., and after returning the pressure within the flask to atmospheric pressure, 300 g of trimellitic anhydride were added to the flask. The contents of the flask were maintained at 215° C. for 1 h, and then the pressure within the flask was further reduced and maintained under 8.3 kPa for 3 h, thereby obtaining a non-crystalline polyester (E). As a result, it was confirmed that the thus obtained non-crystalline polyester (E) had a glass transition point of 57° C., a softening point of 118° C., a crystallinity index of 1.5, an acid value of 19.1 mgKOH/g and a number-average molecular weight of 3,000.

Production Example 6

Production of Non-Crystalline Polyester (F)

An inside atmosphere of a four-necked flask equipped with a nitrogen inlet tube, a dehydration tube, a stirrer and a thermocouple was replaced with nitrogen, and 5670 g of polyoxypropylene (2.2)-2,2-bis(4-hydroxyphenyl)propane, 585 g of polyoxyethylene (2.0)-2,2-bis(4-hydroxyphenyl) propane, 2450 g of terephthalic acid and 44 g of di(2-ethyl-hexanoic acid) were charged into the flask. The contents of the flask were heated to 235° C. in a nitrogen atmosphere while stirring and maintained at 235° C. for 5 h, and then the pressure within the flask was reduced and maintained under 8.0 kPa for 1 h. After returning the pressure within the flask to atmospheric pressure, the contents of the flask were cooled to 190° C., and 42 g of fumaric acid and 207 g of trimellitic acid were added to the flask. The contents of the flask were maintained at 190° C. for 2 h, and then heated to 210° C. over 2 h, and thereafter the pressure within the flask was further reduced and maintained under 8.0 kPa for 4 h, thereby obtaining a non-crystalline polyester (F). As a result, it was confirmed that the thus obtained non-crystalline polyester (F) had a glass transition point of 67° C., a softening point of 106° C., a crystallinity index of 1.5, an acid value of 19.4 mgKOH/g and a number-average molecular weight of 1,900.

The raw materials and properties of the polyesters obtained in the above Production Examples 1 to 6 are shown below in Tables 1 and 2.

TABLE 1

| Crystalline polyester | A | |
|---|---|---|
| Raw material monomer | g | mol %*1 |
| Alcohol component: 1,12-Dodecanediol | 5050 | 100 |
| Acid component: Succinic acid | 2950 | 100 |
| Properties | | |
| Acid value (mgKOH/g) | 8.2 | |
| Softening point (° C.) | 87 | |
| Melting point by DSC (° C.) | 79 | |
| Crystallinity index | 1.1 | |

Note
*1mol %: Molar ratio assuming that an amount (mol) of the alcohol component is 100.

TABLE 2

| Non-crystalline polyester | B | | C | | D | | E | | F | |
|---|---|---|---|---|---|---|---|---|---|---|
| Raw material monomer | g | mol %*4 | g | mol %*4 | g | mol %*4 | g | mol %*4 | g | mol %*4 |
| Alcohol component | | | | | | | | | | |
| BPA—PO*2 | 1750 | 50 | 3374 | 96 | 3004 | 96 | 3528 | 70 | 5670 | 90 |
| BPA—EO*3 | 1625 | 50 | 33 | 1 | | | 1404 | 30 | 585 | 10 |
| Acid component | | | | | | | | | | |
| Terephthalic acid | 1145 | 57 | 672 | 40 | | | 1248 | 51 | 2450 | 82 |
| Fumaric acid | | | 696 | 60 | 996 | 100 | | | 42 | 2 |
| Dodecenylsuccinic anhydride | 161 | 5 | | | | | 1541 | 39 | | |
| Trimellitic anhydride | 480 | 21 | | | | | 300 | 10 | 207 | 6 |
| Properties | | | | | | | | | | |
| Acid value (mgKOH/g) | 21.0 | | 24.4 | | 22.4 | | 19.1 | | 19.4 | |
| Softening point (° C.) | 122 | | 107 | | 101 | | 118 | | 106 | |
| Glass transition temperature (° C.) | 64 | | 65 | | 57 | | 57 | | 67 | |
| Crystallinity index | 1.6 | | 1.5 | | 1.5 | | 1.5 | | 1.5 | |

Note
*2BPA—PO: Polyoxypropylene (2.2) adduct of bisphenol A
*3BPA—EO: Polyoxyethylene (2.0) adduct of bisphenol A
*4mol %: Molar ratio assuming that a whole amount (mol) of the alcohol component or acid component is 100.

Production Example 7

Production of Colorant-Containing Master Batch (G)

Seventy parts by mass of fine particles of the polyester (D) obtained in Production Example 4 and 30 parts by mass (in terms of a pigment content) of a slurry pigment of copper phthalocyanine "ECB-301" (tradename) (solid content of 46.2% by mass) available from Dainichiseika Co., Ltd., were charged into a Henschel mixer, and mixed with each other for 5 min to obtain a wet mixture. The resulting mixture was charged into a kneader-type mixer and gradually heated. The resin was melted at a temperature of about 90 to about 110° C., and the mixture was kneaded under the condition that water was still present therein, and further continuously kneaded at a temperature of 90 to 110° C. for 20 min while evaporating water therefrom.

The resulting kneaded material was continuously kneaded at 120° C. to evaporate residual water therefrom, followed by dehydrating and drying, and further continuously kneaded at a temperature of 120 to 130° C. for 10 min. After cooling, the obtained kneaded material was further kneaded with a heating three-roll mill, cooled and coarsely crushed, thereby obtaining a high-concentration colored composition in the form of coarse particles containing 30% by mass of a blue pigment as a master batch (G). The resulting composition was placed on a slide glass, and heated and melted. As a result of observing the melted composition by using a microscope, it was confirmed that the whole pigment particles were finely dispersed in the composition, and no coarse particles were present therein.

[Production of Dispersion of Resin Particles]

Production Example a1

Production of Dispersion of Resin Particles (A-1)

A flask equipped with a stirrer was charged with 120 g of the crystalline polyester (A), 255 g of the non-crystalline polyester (C), 120 g of the non-crystalline polyester (E), 150 g of the copper phthalocyanine pigment-containing master batch (G), 8.5 g of a polyoxyethylene alkyl ether as a nonionic surfactant "EMALGEN 150" (tradename) available from Kao Corporation, 80 g of a 15 mass % aqueous solution of sodium dodecylbenzenesulfonate as an anionic surfactant "NEOPELEX G-15" (tradename) available from Kao Corporation, and 270 g of a 5 mass % potassium hydroxide aqueous solution, and the contents of the flask were heated to 98° C. and melted while stirring, and mixed at 98° C. for 2 h, thereby obtaining a resin mixture.

Then, while stirring the mixture, 1113 g of deionized water were added dropwise into the flask at a rate of 6 g/min to prepare an emulsion. Next, the obtained emulsion was cooled to 25° C. and passed through a 200-mesh wire screen (opening: 105 μm) to obtain a dispersion of resin particles.

Furthermore, the thus obtained dispersion of the resin particles was mixed with 22.7 g of an aqueous solution of an oxazoline group-containing acrylic polymer "EPOCROSS WS-700" (tradename) available from Nippon Shokubai Co., Ltd., (solid content: 25% by mass; acrylic main chain; content of oxazoline group in oxazoline group-containing polymer: 4.55 mmol/g; number-average molecular weight: 20,000, hereinafter defined in the same way), and maintained at 95° C. for 1 h while stirring. Then, the resulting emulsion was cooled to 25° C. and passed through a 200-mesh wire screen, and deionized water was added thereto to adjust a solid content thereof to 30% by mass, thereby obtaining a dispersion of resin particles (A-1). As a result, it was confirmed that the resin particles (A-1) had a volume-median particle size of 0.171 μm and CV of 30.6%.

Production Example A2

Production of Dispersion of Resin Particles (A-2)

A flask as a reaction vessel having a capacity of 5 L was charged with 210 g of the non-crystalline polyester (B), 390 g of the non-crystalline polyester (C), 6 g of a polyoxyethylene alkyl ether as a nonionic surfactant "EMALGEN 430" (tradename) available from Kao Corporation, 40 g of a 15 mass % aqueous solution of sodium dodecylbenzenesulfonate "NEOPELEX G-15", and 278 g of a 5 mass % potassium hydroxide aqueous solution, and the contents of the flask were heated to 95° C. and melted while stirring, and mixed at 95° C. for 2 h, thereby obtaining a resin mixture.

Then, while stirring the mixture, 1135 g of deionized water were added dropwise into the flask at a rate of 6 g/min to prepare an emulsion. Next, the obtained emulsion was cooled to 25° C. and passed through a 200-mesh wire screen, and deionized water was added thereto to adjust a solid content thereof to 16.5% by mass, thereby obtaining a dispersion of resin particles (A-2). As a result, it was confirmed that the resin particles (A-2) had a volume-median particle size of 0.158 μm, CV of 24.0% and a glass transition point of 60° C.

Production Example A3

Production of Dispersion of Resin Particles (A-3)

A flask equipped with a stirrer was charged with 90 g of the crystalline polyester (A), 285 g of the non-crystalline polyester (C), 120 g of the non-crystalline polyester (E), 150 g of the copper phthalocyanine pigment-containing master batch (G), 8.5 g of a polyoxyethylene alkyl ether as a nonionic surfactant "EMALGEN 150" (tradename) available from Kao Corporation, 80 g of a 15 mass % aqueous solution of sodium dodecylbenzenesulfonate as an anionic surfactant "NEOPELEX G-15" (tradename) available from Kao Corporation, and 270 g of a 5 mass % potassium hydroxide aqueous solution, and the contents of the flask were heated to 95° C. and melted while stirring, and mixed at 95° C. for 2 h, thereby obtaining a resin mixture.

Then, while stirring the mixture, 1113 g of deionized water were added dropwise into the flask at a rate of 6 g/min to prepare an emulsion. Next, the obtained emulsion was cooled to 25° C. and passed through a 200-mesh wire screen (opening: 105 μm) to obtain a dispersion of resin particles.

Furthermore, the thus obtained dispersion of the resin particles was mixed with 22.7 g of an aqueous solution of an oxazoline group-containing acrylic polymer "EPOCROSS WS-700" (tradename) available from Nippon Shokubai Co., Ltd., and maintained at 95° C. for 1 h while stirring. Then, the resulting emulsion was cooled to 25° C. and passed through a 200-mesh wire screen, and deionized water was added thereto to adjust a solid content thereof to 30% by mass, thereby obtaining a dispersion of resin particles (A-3). As a result, it was confirmed that the resin particles (A-3) had a volume-median particle size of 0.143 μm and CV of 29.8%.

Production Example A4

Production of Dispersion of Resin Particles (A-4)

A flask equipped with a stirrer was charged with 90 g of the crystalline polyester (A), 285 g of the non-crystalline polyester (C), 120 g of the non-crystalline polyester (E), 150 g of the copper phthalocyanine pigment-containing master batch (G), 8.5 g of a polyoxyethylene alkyl ether as a nonionic surfactant "EMALGEN 150" (tradename) available from Kao Corporation, 80 g of a 15 mass % aqueous solution of sodium dodecylbenzenesulfonate as an anionic surfactant "NEOPELEX G-15" (tradename) available from Kao Corporation, and 270 g of a 5 mass % potassium hydroxide aqueous solution, and the contents of the flask were heated to 95° C. and melted while stirring, and mixed at 95° C. for 2 h, thereby obtaining a resin mixture.

Then, while stirring the mixture, 1113 g of deionized water were added dropwise into the flask at a rate of 6 g/min to prepare an emulsion. Next, the obtained emulsion was cooled to 25° C. and passed through a 200-mesh wire screen (opening: 105 μm), and deionized water was added thereto to adjust a solid content thereof to 16.5% by mass, thereby obtaining a dispersion of resin particles (A-4). As a result, it was confirmed that the resin particles (A-4) had a volume-median particle size of 0.145 μm and CV of 33.1%.

Production Example A5

Production of Dispersion of Resin Particles (A-5)

A flask equipped with a stirrer was charged with 90 g of the crystalline polyester (A), 285 g of the non-crystalline polyester (C), 120 g of the non-crystalline polyester (E), 150 g of the copper phthalocyanine pigment-containing master batch (G), 40 g of a 15 mass % aqueous solution of sodium dodecylbenzenesulfonate as an anionic surfactant "NEOPELEX G-15" (tradename) available from Kao Corporation, 58.6 g of a 24 mass % potassium hydroxide aqueous solution, and 185 g of deionized water, and the contents of the flask were heated to 95° C. and melted while stirring, and mixed at 95° C. for 2 h, thereby obtaining a resin mixture.

Then, while stirring the mixture, 1213 g of deionized water were added dropwise into the flask at a rate of 6 g/min to prepare an emulsion. Next, the obtained emulsion was cooled to 25° C. and passed through a 200-mesh wire screen (opening: 105 μm), and deionized water was added thereto to adjust a solid content thereof to 30% by mass, thereby obtaining a dispersion of resin particles (A-5). As a result, it was confirmed that the resin particles (A-5) had a volume-median particle size of 0.144 μm and CV of 28.0%.

Production Example A6

Production of Dispersion of Resin Particles (A-6)

A flask equipped with a stirrer was charged with 60 g of the crystalline polyester (A), 315 g of the non-crystalline polyester (C), 120 g of the non-crystalline polyester (E), 150 g of the copper phthalocyanine pigment-containing master batch (G), 6 g of sodium lauroyl methyl taurine as an anionic surfactant "NIKKOL LMT" (tradename) available from Nikko Chemicals Co., Ltd., 45 g of a vinyl chloride-based copolymer emulsion "VINYBLAN 700" (tradename) (solid content: 30% by mass; acid value of resin: 190 mgKOH/g; glass transition point: 73° C.; average particle size: 30 nm) available from Nissin Chemical Industry Co., Ltd., 57.6 g of a 24 mass % potassium hydroxide aqueous solution, and 184 g of deionized water, and the contents of the flask were heated to 95° C. and melted while stirring, and mixed at 95° C. for 2 h, thereby obtaining a resin mixture.

Then, while stirring the mixture, 1178 g of deionized water were added dropwise into the flask at a rate of 6 g/min to prepare an emulsion. Next, the obtained emulsion was cooled to 25° C. and passed through a 200-mesh wire screen (opening: 105 μm) to obtain a dispersion of resin particles.

Furthermore, the thus obtained dispersion of the resin particles was mixed with 22.7 g of an aqueous solution of an oxazoline group-containing acrylic polymer "EPOCROSS WS-700" (tradename) available from Nippon Shokubai Co., Ltd., and maintained at 95° C. for 1 h while stirring. Then, the resulting emulsion was cooled to 25° C. and passed through a 200-mesh wire screen, and deionized water was added thereto to adjust a solid content thereof to 30% by mass, thereby obtaining a dispersion of resin particles (A-6). As a result, it was confirmed that the resin particles (A-6) had a volume-median particle size of 0.159 μm and CV of 29.1%.

Production Example A7

Production of Dispersion of Resin Particles (A-7)

A flask equipped with a stirrer was charged with 90 g of the crystalline polyester (A), 285 g of the non-crystalline polyester (C), 120 g of the non-crystalline polyester (E), 150 g of the copper phthalocyanine pigment-containing master batch (G), 40 g of a 15 mass % aqueous solution of sodium dodecylbenzenesulfonate as an anionic surfactant "NEOPELEX G-15" (tradename) available from Kao Corporation, 45 g of a vinyl chloride-based copolymer emulsion "VINYBLAN 700" (tradename) (solid content: 30% by mass; acid value of resin: 190 mgKOH/g; glass transition point: 73° C.; average particle size: 30 nm) available from Nissin Chemical Industry Co., Ltd., 58.5 g of a 24 mass % potassium hydroxide aqueous solution, and 180 g of deionized water, and the contents of the flask were heated to 95° C. and melted while stirring, and mixed at 95° C. for 2 h, thereby obtaining a resin mixture.

Then, while stirring the mixture, 1182 g of deionized water were added dropwise into the flask at a rate of 6 g/min to prepare an emulsion. Next, the obtained emulsion was cooled to 25° C. and passed through a 200-mesh wire screen (opening: 105 μm), and deionized water was added thereto to adjust a solid content thereof to 30% by mass, thereby obtaining a dispersion of resin particles (A-7). As a result, it was confirmed that the resin particles (A-7) had a volume-median particle size of 0.123 μm and CV of 26.0%.

Production Example A8

Production of Dispersion of Resin Particles (A-8)

A flask equipped with a stirrer was charged with 405 g of the non-crystalline polyester (C), 90 g of the non-crystalline polyester (E), 150 g of the copper phthalocyanine pigment-containing master batch (G), 40 g of a 15 mass % aqueous solution of sodium dodecylbenzenesulfonate as an anionic surfactant "NEOPELEX G-15" (tradename) available from Kao Corporation, 45 g of a vinyl chloride-based copolymer emulsion "VINYBLAN 700" (tradename) (solid content: 30% by mass; acid value of resin: 190 mgKOH/g; glass transition point: 73° C.; average particle size: 30 nm) available from Nissin Chemical Industry Co., Ltd., 28.3 g of a 48 mass % potassium hydroxide aqueous solution, and 241 g of deionized water, and the contents of the flask were heated to 98° C. and melted while stirring, and mixed at 98° C. for 2 h, thereby obtaining a resin mixture.

Then, while stirring the mixture, 1193 g of deionized water were added dropwise into the flask at a rate of 6 g/min to prepare an emulsion. Next, the obtained emulsion was cooled to 25° C. and passed through a 200-mesh wire screen (opening: 105 μm), and deionized water was added thereto to adjust a solid content thereof to 30% by mass, thereby obtaining a dispersion of resin particles (A-8). As a result, it was confirmed that the resin particles (A-8) had a volume-median particle size of 0.131 μm and CV of 28.6%.

The raw materials of the dispersions of the resin particles (A-1) to (A-8) produced in the above Production Examples A1 to A8 are shown below in Table 3.

TABLE 3

| Dispersion of resin particles | A-1 | A-2 | A-3 | A-4 | A-5 | A-6 | A-7 | A-8 |
|---|---|---|---|---|---|---|---|---|
| Crystalline polyester (A) | 120 g | | 90 g | 90 g | 90 g | 60 g | 90 g | |
| Non-crystalline polyester (B) | | 210 g | | | | | | |
| Non-crystalline polyester (C) | 255 g | 390 g | 285 g | 285 g | 285 g | 315 g | 285 g | 405 g |
| Non-crystalline polyester (E) | 120 g | | 120 g | 120 g | 120 g | 120 g | 120 g | 90 g |
| Copper phthalocyanine pigment-containing master batch (G) (70 parts by mass of non-crystalline polyester (D)/30 parts by mass of copper phthalocyanine pigment) | 150 g | | 150 g | 150 g | 150 g | 150 g | 150 g | 150 g |
| 15 mass % Aqueous solution of sodium dodecylbenzenesulfonate ("NEOPELEX G-15") | 80 g | 40 g | 80 g | 80 g | 40 g | | 40 g | 40 g |
| Sodium lauroyl methyl taurine ("NIKKOL LMT") | | | | | | 6.0 g | | |
| Polyoxyethylene alkyl ether ("EMALGEN 150") | 8.5 g | | 8.5 g | 8.5 g | | | | |
| Polyoxyethylene alkyl ether ("EMALGEN 430") | | 6 g | | | | | | |
| Vinyl chloride-based copolymer emulsion (solid content: 30% by mass; acid value: 190 mgKOH/g) | | | | | | 45 g | 45 g | 45 g |
| Aqueous solution of oxazoline group-containing acrylic polymer (solid content: 25% by mass) | 22.7 g | | 22.7 g | | | 22.7 g | | |

Production Example E1

Production of Resin Emulsion (E−1)

A flask as a reaction vessel having a capacity of 5 L was charged with 600 g of the non-crystalline polyester (F), 6 g of a polyoxyethylene alkyl ether as a nonionic surfactant "EMALGEN 430" (tradename) available from Kao Corporation, 40 g of a 15 mass % aqueous solution of sodium dodecylbenzenesulfonate as an anionic surfactant "NEOPELEX G-15" (tradename) available from Kao Corporation, and 233 g of a 5 mass % potassium hydroxide aqueous solution, and the contents of the flask were heated to 95° C. and melted while stirring, and mixed at 95° C. for 2 h, thereby obtaining a resin mixture.

Then, while stirring the mixture, 1145 g of deionized water were added dropwise into the flask at a rate of 6 g/min to prepare an emulsion. Next, the obtained emulsion was cooled to 25° C. and passed through a 200-mesh wire screen, and deionized water was added thereto to adjust a solid content thereof to 30% by mass, thereby obtaining a resin emulsion (E−1). As a result, it was confirmed that the resin emulsion (E−1) had a volume-median particle size of 0.096 μm and CV of 21.2%.

[Production of Dispersions of Releasing Agent Particles]

Production Example W1

Production of Dispersion of Releasing Agent Particles (W-1)

In a 500 mL beaker, 9 g of a carnauba wax "Carnauba Wax #1" (tradename) (melting point: 83° C.; acid value: 5 mgKOH/g) available from Kato Yoko Co., Ltd., 81 g of a paraffin wax "HNP-9" (tradename) (melting point: 75° C.) available from Nippon Seiro Co., Ltd., 5.52 g of an aqueous solution of an oxazoline group-containing acrylic polymer "EPOCROSS WS-700" (tradename) available from Nippon Shokubai Co., Ltd., and 18.0 g of a vinyl chloride-based copolymer emulsion "VINYBLAN 700" (tradename) (solid content: 30% by mass; acid value of resin: 190 mgKOH/g; glass transition point: 73° C.; average particle size: 30 nm) available from Nissin Chemical Industry Co., Ltd., were added to 250 g of deionized water, and the contents of the beaker were heated to 95° C., and maintained at 95° C. to melt and mix the waxes. Thereafter, while maintaining the resulting mixture at 95° C., the mixture was stirred using a homomixer for 30 min to obtain a preliminary emulsion. While maintaining the obtained preliminary emulsion in a temperature range of 80 to 95° C., the emulsion was treated by a nanomizer "NM2-L200-D08" (tradename) available from Yoshida Kikai Co., Ltd., under a pressure of 100 MPa three times, and then cooled to room temperature (20° C.), and ion-exchanged water was added to the obtained emulsion to adjust a solid content of a releasing agent therein to 20% by mass, thereby obtaining a dispersion of releasing agent particles (W-1). As a result, it was confirmed that the releasing agent particles (W-1) in the resulting dispersion had a volume-median particle size ($D_{50}$) of 540 nm and CV of 24.4%.

Production Example W2

Production of Water Dispersion of Releasing Agent Particles (W-2)

In a 500 mL beaker, 9 g of a carnauba wax "Carnauba Wax #1" (tradename) (melting point: 83° C.; acid value: 5 mgKOH/g) available from Kato Yoko Co., Ltd., and 81 g of a paraffin wax "HNP-9" (tradename) (melting point: 75° C.) available from Nippon Seiro Co., Ltd., were added to 250 g of deionized water, and the contents of the beaker were heated to 95° C., and maintained at 95° C. to melt and mix the waxes. Thereafter, while maintaining the resulting mixture at 95° C., 5.52 g of an aqueous solution of an oxazoline group-containing acrylic polymer "EPOCROSS WS-700" (tradename) available from Nippon Shokubai Co., Ltd., were added thereto, and the obtained mixture was stirred using a homomixer for 15 min. Then, 18.0 g of a vinyl chloride-based copolymer emulsion "VINYBLAN 700" (tradename) (solid content: 30% by mass; acid value of resin: 190 mgKOH/g; glass transition point: 73° C.; average particle size: 30 nm) available from Nissin Chemical Industry Co., Ltd., were added to the mixture at the same temperature, and the obtained dispersion was further stirred using a homomixer for 15 min to obtain a preliminary emulsion. While maintaining the obtained preliminary emulsion in a temperature range of 80 to 95° C., the preliminary emulsion was treated by a nanomizer "NM2-L200-D08" (tradename) available from Yoshida Kikai Co., Ltd., under a pressure of 100 MPa three times, and then cooled to room temperature, and ion-exchanged water was added to the obtained emulsion to adjust a solid content of a releasing agent therein to 20% by mass, thereby obtaining a dispersion of releasing agent particles (W-2). As a result, it was confirmed that the releasing agent particles (W-2) in the resulting dispersion had a volume-median particle size ($D_{50}$) of 628 nm and CV of 27.3%.

Production Example W3

Production of Dispersion of Releasing Agent Particles (W-3)

The same procedure as in Production Example W2 was repeated except that the carnauba wax, the paraffin wax and the aqueous solution of the oxazoline group-containing acrylic polymer were used in amounts of 27 g, 63 g and 6.92 g, respectively, thereby obtaining a dispersion of releasing agent particles (W-3). As a result, it was confirmed that the releasing agent particles (W-3) in the resulting dispersion had a volume-median particle size ($D_m$) of 648 nm and CV of 31.2%.

Production Example W4

Production of Dispersion of Releasing Agent Particles (W-4)

The same procedure as in Production Example W2 was repeated except that no carnauba wax was used, and the paraffin wax and the aqueous solution of the oxazoline group-containing acrylic polymer were used in amounts of 90 g and 4.82 g, respectively, thereby obtaining a dispersion of releasing agent particles (W-4). As a result, it was confirmed that the releasing agent particles (W-4) in the resulting dispersion had a volume-median particle size ($D_{50}$) of 625 nm and CV of 29.6%.

Production Example W5

Production of Dispersion of Releasing Agent Particles (W-5)

The same procedure as in Production Example W2 was repeated except that the aqueous solution of the oxazoline group-containing acrylic polymer was used in an amount of 0 g, i.e., the aqueous solution of the oxazoline group-containing acrylic polymer was not used, thereby obtaining a dispersion of releasing agent particles (W-5). As a result, it was confirmed that the releasing agent particles (W-5) in the resulting dispersion had a volume-median particle size ($D_{50}$) of 462 nm and CV of 25.3%.

Production Example W6

Production of Dispersion of Releasing Agent Particles (W-6)

In a 500 mL beaker, 9 g of a carnauba wax "Carnauba Wax #1" (tradename) (melting point: 83° C.; acid value: 5 mgKOH/g) available from Kato Yoko Co., Ltd., and 81 g of a paraffin wax "HNP-9" (tradename) (melting point: 75° C.) available from Nippon Seiro Co., Ltd., were added to 250 g of deionized water, and the contents of the beaker were maintained at 95° C. to melt and mix the waxes. Thereafter, while maintaining the resulting mixture at 95° C., 3.04 g of an aqueous solution of an oxazoline group-containing acrylic polymer "EPOCROSS WS-700" (tradename) available from Nippon Shokubai Co., Ltd., were added thereto, and the obtained mixture was stirred using a homomixer for 15 min. Then, 1.8 g of a sucrose stearic acid ester "RYOTO Sugar Ester 51170" (tradename) available from Mitsubishi-Kagaku Foods Corporation and 1.8 g of a sucrose stearic acid ester "RYOTO Sugar Ester 5570" (tradename) available from Mitsubishi-Kagaku Foods Corporation were added to the mixture, and the obtained dispersion was further stirred using a homomixer for 15 min to obtain a preliminary emulsion. While maintaining the obtained preliminary emulsion in a temperature range of 80 to 95° C., the preliminary emulsion was treated by a nanomizer "NM2-L200-D08" (tradename) available from Yoshida Kikai Co., Ltd., under a pressure of 20 MPa two times, and then cooled to room temperature, and ion-exchanged water was added to the obtained emulsion to adjust a solid content of a releasing agent therein to 20% by mass, thereby obtaining a dispersion of releasing agent particles (W-6). As a result, it was confirmed that the releasing agent particles (W-6) in the resulting dispersion had a volume-median particle size ($D_{50}$) of 458 nm and CV of 26.5%.

Production Example W7

Production of Dispersion of Releasing Agent Particles (W-7)

The same procedure as in Production Example W6 was repeated except that 6.22 g of behenic acid "LUNAC BA" (tradename) (acid value: 165 mgKOH/g) available from Kao Corporation were added together with the carnauba wax and the paraffin wax, thereby obtaining a dispersion of releasing agent particles (W-7). As a result, it was confirmed that the releasing agent particles (W-7) in the resulting dispersion had a volume-median particle size ($D_{50}$) of 385 nm and CV of 25.4%.

Production Example W8

Production of Dispersion of Releasing Agent Particles (W-8)

The same procedure as in Production Example W-4 was repeated except that in Production Example 7, no carnauba wax was used, and the paraffin wax was used in an amount of 90 g, thereby obtaining a dispersion of releasing agent particles (W-8). As a result, it was confirmed that the releasing agent particles (W-8) in the resulting dispersion had a volume-median particle size ($D_{50}$) of 266 nm and CV of 25.2%.

Production Example W9

Production of Dispersion of Releasing Agent Particles (W-9)

In a 500 mL beaker, 27 g of a carnauba wax "Carnauba Wax #1" (tradename) (melting point: 83° C.; acid value: 5 mgKOH/g) available from Kato Yoko Co., Ltd., and 63 g of a paraffin wax "HNP-9" (tradename) (melting point: 75° C.) available from Nippon Seiro Co., Ltd., were added to 250 g of deionized water, and the contents of the beaker were maintained at 95° C. to melt and mix the waxes. Thereafter, while maintaining the resulting mixture at 95° C., 5.98 g of an aqueous solution of an oxazoline group-containing acrylic polymer "EPOCROSS WS-700" (tradename) available from Nippon Shokubai Co., Ltd., were added thereto, and the obtained mixture was stirred using a homomixer for 15 min. Then, 18.0 g of a vinyl chloride-based copolymer emulsion "VINYBLAN 701" (tradename) (solid content: 30% by mass; acid value of resin: 153 mgKOH/g; glass transition point: 70° C.; average particle size: 30 nm) available from Nissin Chemical Industry Co., Ltd., were added to the mixture, and the obtained dispersion was further stirred using a homomixer for 15 min to obtain a preliminary emulsion. While maintaining the obtained preliminary emulsion in a temperature range of 80 to 95° C., the preliminary emulsion was treated by a nanomizer "NM2-L200-D08" (tradename) available from Yoshida Kikai Co., Ltd., under a pressure of 100 MPa three times, and then cooled to room temperature, and ion-exchanged water was added to the obtained emulsion to adjust a solid content of a releasing agent therein to 20% by mass, thereby obtaining a dispersion of releasing agent particles (W-9). As a result, it was confirmed that the releasing agent particles (W-9) in the resulting dispersion had a volume-median particle size ($D_{50}$) of 811 nm and CV of 35.4%.

Production Example W10

Production of Dispersion of Releasing Agent Particles (W-10)

In a 500 mL beaker, 27 g of a carnauba wax "Carnauba Wax #1" (tradename) (melting point: 83° C.; acid value: 5 mgKOH/g) available from Kato Yoko Co., Ltd., and 63 g of a paraffin wax "HNP-9" (tradename) (melting point: 75° C.) available from Nippon Seiro Co., Ltd., were added to 250 g of deionized water, and the contents of the beaker were maintained at 95° C. to melt and mix the waxes. Thereafter, while maintaining the resulting mixture at 95° C., 3.18 g of an aqueous solution of an oxazoline group-containing acrylic polymer "EPOCROSS WS-700" (tradename) available from Nippon Shokubai Co., Ltd., were added thereto, and the obtained mixture was stirred using a homomixer for 15 min. Then, 1.5 g of a vinyl chloride-based copolymer emulsion "VINYBLAN 701" (tradename) (solid content: 30% by mass; acid value of resin: 153 mgKOH/g; glass transition point: 70° C.; average particle size: 30 nm) available from Nissin Chemical Industry Co., Ltd., were added to the mixture, and the obtained mixture was stirred using a homomixer for 10 min. Then, 0.84 g of a 1 mol/L sodium hydroxide aqueous solution was added the mixture to adjust a pH value of the mixture from 7.23 to 9.30, and the obtained dispersion was further stirred using a homomixer for 10 min to obtain a preliminary emulsion. While maintaining the obtained preliminary emulsion in a temperature range of 80 to 95° C., the preliminary emulsion was treated by a nanomizer "NM2-L200-D08" (tradename) available from Yoshida Kikai Co., Ltd., under a pressure of 100 MPa three times, and then cooled to room temperature, and ion-exchanged water was added to the obtained emulsion to adjust a solid content of a releasing agent therein to 20% by mass, thereby obtaining a dispersion of releasing agent particles (W-10). As a result, it was confirmed that the releasing agent particles (W-10) in the resulting dispersion had a volume-median particle size ($D_{50}$) of 571 nm and CV of 26.9%.

Production Example W11

Production of Dispersion of Releasing Agent Particles (W-11)

The same procedure as in Production Example W9 was repeated except that 12.0 g of a styrene-acrylic acid copolymer emulsion "JONCRYL PDX7667" (tradename) (solid content: 45% by mass; acid value of resin: 182 mgKOH/g; glass transition point: 75° C.; average particle size: 90 nm) available from BASF Japan Ltd., were used in place of the vinyl chloride-based copolymer emulsion, and the aqueous solution of the oxazoline group-containing acrylic polymer was used in an amount of 6.92 g, thereby obtaining a dispersion of releasing agent particles (W-11). As a result, it was confirmed that the releasing agent particles (W-11) in the resulting dispersion had a volume-median particle size ($D_{50}$) of 548 nm and CV of 29.5%.

Production Example W12

Production of Dispersion of Releasing Agent Particles (W-12)

In a 500 mL beaker, 9 g of a carnauba wax "Carnauba Wax #1" (tradename) (melting point: 83° C.; acid value: 5 mgKOH/g) available from Kato Yoko Co., Ltd., and 81 g of a paraffin wax "HNP-9" (tradename) (melting point: 75° C.) available from Nippon Seiro Co., Ltd., were added to 250 g of deionized water, and the contents of the beaker were maintained at 95° C. to melt and mix the waxes. Thereafter, while maintaining the resulting mixture at 95° C., 6.78 g of an aqueous solution of an oxazoline group-containing acrylic polymer "EPOCROSS WS-700" (tradename) available from Nippon Shokubai Co., Ltd., were added thereto, and the resulting mixture was stirred using a homomixer for 15 min. Then, 30.0 g of the resin particles (E−1) (solid content: 30% by mass; acid value of resin: 19.4 mgKOH/g; glass transition point: 67° C.; average particle size: 96 nm) were added to the mixture, and the obtained dispersion was further stirred using a homomixer for 15 min to obtain a preliminary emulsion. While maintaining the obtained preliminary emulsion in a temperature range of 80 to 95° C., the emulsion was treated by a nanomizer "NM2-L200-D08" (tradename) available from Yoshida Kikai Co., Ltd., under a pressure of 20 MPa two times, and then cooled to room temperature, and ion-exchanged water was added to the obtained emulsion to adjust a solid content of a releasing agent therein to 20% by mass, thereby obtaining a dispersion of releasing agent particles (W-12). As a result, it was confirmed that the releasing agent particles (W-12) in the resulting dispersion had a volume-median particle size ($D_{50}$) of 422 nm and CV of 25.8%.

Production Example W13

Production of Dispersion of Releasing Agent Particles (W-13)

The same procedure as in Production Example W12 was repeated except that after preparing the preliminary emulsion, 0.18 g of 1 mol/L sulfuric acid was added thereto to adjust a pH value thereof from 7.63 to 7.23, and then the obtained dispersion was further stirred using a homomixer for 15 min to obtain a preliminary emulsion, and the obtained preliminary emulsion was treated by the nanomizer under a pressure of 50 MPa two times, thereby obtaining a dispersion of releasing agent particles (W-13). As a result, it was confirmed that the releasing agent particles (W-13) in the resulting dispersion had a volume-median particle size ($D_{50}$) of 621 nm and CV of 39.2%.

Production Example W14

Production of Dispersion of Releasing Agent Particles (W-14)

The same procedure as in Production Example W9 was repeated except that 2.64 g of a styrene-acrylic acid copolymer aqueous solution "JONCRYL 60J" (tradename) (solid content: 34% by mass; acid value of resin: 632 mgKOH/g; glass transition point: 85° C.) available from BASF Japan Ltd., were used in place of the vinyl chloride-based copolymer emulsion, and the aqueous solution of the oxazoline group-containing acrylic polymer was used in an amount of 11.0 g, thereby obtaining a dispersion of releasing agent particles (W-14). As a result, it was confirmed that the releasing agent particles (W-14) in the resulting dispersion had a volume-median particle size ($D_{50}$) of 936 nm and CV of 44.6%.

Production Example W15

Production of Water Dispersion of Releasing Agent Particles (W-15)

In a 500 mL beaker, 27 g of a carnauba wax "Carnauba Wax #1" (tradename) (melting point: 83° C.; acid value: 5 mgKOH/g) available from Kato Yoko Co., Ltd., and 63 g of a paraffin wax "HNP-9" (tradename) (melting point: 75° C.) available from Nippon Seiro Co., Ltd., were added to 171 g of deionized water, and the contents of the beaker were heated to 95° C., and maintained at 95° C. to melt and mix the waxes. Thereafter, while maintaining the resulting mixture at 95° C., 34.57 g of an aqueous solution of an oxazoline group-containing acrylic polymer "EPOCROSS WS-700" (tradename) available from Nippon Shokubai Co., Ltd., were added thereto, and the obtained mixture was stirred using a homomixer for 15 min. Then, 90.0 g of a vinyl chloride-based copolymer emulsion "VINYBLAN 700" (tradename) (solid content: 30% by mass; acid value of resin: 190 mgKOH/g; glass transition point: 73° C.; average particle size; 30 nm) available from Nissin Chemical Industry Co., Ltd., were added to the mixture at the same temperature, and the obtained mixture was further stirred using a homomixer for 15 min. Then, 0.59 g of 1 mol/L sulfuric acid was added the mixture to adjust a pH value thereof from 7.91 to 7.70, and the obtained dispersion was further stirred using a homomixer for 15 min to obtain a preliminary emulsion. While maintaining the obtained preliminary emulsion in a temperature range of 80 to 95° C., the preliminary emulsion was treated by a nanomizer "NM2-L200-D08" (tradename) available from Yoshida Kikai Co., Ltd., under a pressure of 50 MPa two times, and then cooled to room temperature, and ion-exchanged water was added to the obtained emulsion to adjust a solid content of a releasing agent therein to 20% by mass, thereby obtaining a dispersion of releasing agent particles (W-15). As a result, it was confirmed that the releasing agent particles (W-15) in the resulting dispersion had a volume-median particle size ($D_{50}$) of 288 nm and CV of 26.0%.

The raw materials and properties of the dispersions of the releasing agent particles (W-1) to (W-15) produced in the above Production Examples W1 to W15 are shown below in Table 4.

TABLE 4

| Dispersion of resin releasing particles | W-1 | W-2 | W-3 | W-4 | W-5 | W-6 | W-7 | W-8 |
|---|---|---|---|---|---|---|---|---|
| Components (g) | | | | | | | | |
| Wax | | | | | | | | |
| Carnauba wax (melting point: 83° C.; acid value: 5 mgKOH/g) | 9 | 9 | 27 | 0 | 9 | 9 | 9 | 0 |
| Paraffin wax (melting point: 75° C.) | 81 | 81 | 63 | 90 | 81 | 81 | 81 | 90 |
| Aqueous solution of oxazoline group-containing polymer (solid content: 25% by mass; oxazoline group content: 4.55 mmol/g) | 5.52 | 5.52 | 6.92 | 4.82 | 0 | 3.04 | 6.92 | 6.92 |
| Resin emulsion, etc. | | | | | | | | |
| Vinyl chloride-based copolymer emulsion (solid content: 30% by mass; acid value of resin: 190 mgKOH/g) | 18 | 18 | 18 | 18 | 18 | | | |
| Vinyl chloride-based copolymer emulsion (solid content: 30% by mass; acid value of resin: 153 mgKOH/g) | | | | | | | | |
| Styrene-acrylic acid copolymer emulsion (solid content: 45% by mass; acid value of resin: 182 mgKOH/g) | | | | | | | | |
| Polyester resin emulsion E-1 (solid content: 30% by mass; acid value of resin: 19.4 mgKOH/g) | | | | | | | | |
| Sucrose stearic acid ester (acid value: 0 mgKOH/g) | | | | | | 3.6 | 3.6 | 3.6 |
| Styrene-acrylic acid copolymer aqueous solution (solid content: 34% by mass; acid value of resin: 632 mgKOH/g) | | | | | | | | |
| Behenic acid (acid value: 165 mgKOH/g) | | | | | | | 6.21 | 6.21 |
| Resin emulsion (solid content), etc./wax (mass ratio) | 6/100 | 6/100 | 6/100 | 6/100 | 6/100 | 4/100 | 10.9/100 | 10.9/100 |
| Carboxyl group/oxazoline group (based on resin emulsion)*5 | 2.92 | 2.92 | 2.33 | 3.34 | — | 0 | 0 | 0 |
| Carboxyl group/oxazoline group (based on wax)*6 | 0.13 | 0.13 | 0.3 | 0 | — | 0.23 | 2.63 | 2.32 |
| Carnauba wax/paraffin wax (mass ratio) | 10/90 | 10/90 | 30/70 | 0/100 | 10/90 | 10/90 | 10/90 | 0/100 |
| Adjustment of pH value | None | None | None | None | None | None | None | None |
| Volume median particle size ($D_{50}$) of releasing agent particles [nm] | 540 | 628 | 648 | 625 | 462 | 458 | 385 | 266 |

| Dispersion of resin releasing particles | W-9 | W-10 | W-11 | W-12 | W-13 | W-14 | W-15 |
|---|---|---|---|---|---|---|---|
| Components (g) | | | | | | | |
| Wax | | | | | | | |
| Carnauba wax (melting point: 83° C.; acid value: 5 mgKOH/g) | 27 | 27 | 27 | 9 | 9 | 27 | 27 |
| Paraffin wax (melting point: 75° C.) | 63 | 63 | 63 | 81 | 81 | 63 | 63 |
| Aqueous solution of oxazoline group-containing polymer (solid content: 25% by mass; oxazoline group content: 4.55 mmol/g) | 5.98 | 3.18 | 6.92 | 6.78 | 6.78 | 11 | 34.57 |
| Resin emulsion, etc. | | | | | | | |
| Vinyl chloride-based copolymer emulsion (solid content: 30% by mass; acid value of resin: 190 mgKOH/g) | | | | | | | 90 |
| Vinyl chloride-based copolymer emulsion (solid content: 30% by mass; acid value of resin: 153 mgKOH/g) | 18 | 1.5 | | | | | |
| Styrene-acrylic acid copolymer emulsion (solid content: 45% by mass; acid value of resin: 182 mgKOH/g) | | | 12 | | | | |
| Polyester resin emulsion E-1 (solid content: 30% by mass; acid value of resin: 19.4 mgKOH/g) | | | | 30 | 30 | | |
| Sucrose stearic acid ester (acid value: 0 mgKOH/g) | | | | | | | |

TABLE 4-continued

| | | | | | | | |
|---|---|---|---|---|---|---|---|
| Styrene-acrylic acid copolymer aqueous solution (solid content: 34% by mass; acid value of resin: 632 mgKOH/g) | | | | | | 2.64 | |
| Behenic acid (acid value: 165 mgKOH/g) | | | | | | | |
| Resin emulsion (solid content), etc./wax (mass ratio) | 6/100 | 0.5/100 | 6/100 | 10/100 | 10/100 | 1/100 | 30/100 |
| Carboxyl group/oxazoline group (based on resin emulsion)*5 | 2.17 | 0.34 | 2.23 | 0.44 | 0.44 | 0 | 2.58 |
| Carboxyl group/oxazoline group (based on wax)*6 | 0.35 | 0.67 | 0.3 | 0.12 | 0.12 | 1.00 | 0.07 |
| Carnauba wax/paraffin wax (mass ratio) | 30/70 | 30/70 | 30/70 | 10/90 | 10/90 | 30/70 | 30/70 |
| Adjustment of pH value | None | ** | None | None | *** | None | *** |
| Volume median particle size ($D_{50}$) of releasing agent particles [nm] | 811 | 571 | 548 | 422 | 621 | 936 | 288 |

Note
*5Carboxyl group/oxazoline group: Molar ratio of carboxyl group of resin emulsion, etc. to oxazoline group
*6Carboxyl group/oxazoline group: Molar ratio of carboxyl group of wax to oxazoline group
**: Adjusted by addition of an alkali
***: Adjusted by addition of an acid

[Production of Toners]

Example 1

Production of Toner 1

A 2 L four-necked flask equipped with a dehydration tube, a stirrer and a thermocouple was charged with 250 g of the dispersion of the resin particles (A-1), 41 g of deionized water and 35 g of the dispersion of the releasing agent particles (W-1), and the contents of the flask were mixed with each other at 25° C. Then, while stirring the resulting mixture, an aqueous solution prepared by dissolving 21 g of ammonium sulfate in 252 g of deionized water was added dropwise to the mixture at 25° C. over 10 min. Thereafter, the resulting dispersion was heated to 63° C. and maintained at 63° C. until a volume median particle size of aggregated particles therein reached 4.6 μm, thereby obtaining a dispersion of aggregated particles (1).

While maintaining the obtained dispersion of the aggregated particles (1) at 58° C., 126 g of the dispersion of the resin particles (A-2) were added dropwise thereinto at a dropping rate of 0.7 mL/min to obtain a dispersion of aggregated particles (2). The temperature of the dispersion obtained after completion of the dropwise addition was 58° C.

Added to the dispersion of the aggregated particles (2) was a mixed aqueous solution prepared by mixing 15 g of an anionic surfactant "EMAL (registered trademark) E27C" (tradename) (sodium polyoxyethylene laurylethersulfate; concentration of active ingredients: 27% by mass) available from Kao Corporation, and 1183 g of deionized water. The resulting mixture was heated to 80° C. at a temperature rise rate of 0.5° C./min and maintained at 80° C. for 5 min to fuse the aggregated particles together, thereby obtaining fused particles.

The resulting dispersion of the fused particles was cooled to 30° C., and subjected to suction filtration to separate solid components therefrom. The thus separated solid components were rinsed with deionized water and then dried at 33° C., thereby obtaining toner particles. One hundred parts by mass of the toner particles were charged together with 2.5 parts by mass of a hydrophobic silica "RY50" (tradename) (average particle size: 0.04 μm) available from Nippon Aerosil Co., Ltd., and 1.0 part by mass of a hydrophobic silica "CAB-O-SIL TS720" (tradename) (average particle size: 0.012 μm) available from Cabot Corporation into a Henschel mixer, followed by mixing the respective materials in the mixer while stirring. The resulting mixture was then allowed to pass through a 150 mesh sieve, thereby obtaining a toner 1. Properties and evaluation results of the thus obtained toner are shown in Table 5.

Examples 2 to 4

Production of Toners 2 to 4

The same procedure as in Example 1 was repeated except that the dispersion of the releasing agent particles (W-1) was replaced with the dispersions of the releasing agent particles (W-2), (W-3) and (W-4), respectively, as shown in Table 1, thereby obtaining toners 2 to 4. Properties and evaluation results of the thus obtained toners are shown in Table 5.

Comparative Examples 1 to 4

Production of Toners 5, 6, 7 and 8

The same procedure as in Example 1 was repeated except that the dispersion of the releasing agent particles (W-1) was replaced with the respective dispersions of the releasing agent particles as shown in Table 1, thereby obtaining toners 5, 6, 7 and 8. Properties and evaluation results of the thus obtained toners are shown in Table 5.

Example 5

Production of Toner 9

A 2 L four-necked flask equipped with a dehydration tube, a stirrer and a thermocouple was charged with 250 g of the dispersion of the resin particles (A-3), 40 g of deionized water and 52 g of the dispersion of the releasing agent particles (W-9), and the contents of the flask were mixed with each other at 25° C. Then, while stirring the resulting mixture, an aqueous solution prepared by dissolving 21 g of ammonium sulfate in 239 g of deionized water was added dropwise to the mixture at 25° C. over 10 min. Thereafter, the resulting dispersion was heated to 63° C. and maintained at 63° C. until a volume median particle size of aggregated particles therein reached 4.6 μm, thereby obtaining a dispersion of aggregated particles (1).

After cooling the obtained dispersion of the aggregated particles (1) to 60° C., while heating the dispersion at a temperature rise rate of 0.8° C./min, 126 g of the dispersion of the resin particles (A-4) were added dropwise thereinto at a dropping rate of 0.7 mL/min to obtain a dispersion of aggregated particles (2). The temperature of the dispersion obtained after completion of the dropwise addition was 62° C.

Added to the dispersion of the aggregated particles (2) was a mixed aqueous solution prepared by mixing 15 g of an anionic surfactant "EMAL (registered trademark) E27C" (tradename) (concentration of active ingredients: 27% by mass) available from Kao Corporation, and 1183 g of deionized water. The resulting mixture was heated to 80° C. at a temperature rise rate of 0.5° C./min and maintained at 80° C. for 5 min to fuse the aggregated particles together, thereby obtaining fused particles.

The resulting dispersion of the fused particles was cooled to 30° C., and subjected to suction filtration to separate solid components therefrom. The thus separated solid components were rinsed with deionized water and then dried at 33° C., thereby obtaining toner particles. One hundred parts by mass of the toner particles were charged together with 2.5 parts by mass of a hydrophobic silica "RY50" (tradename) (average particle size: 0.04 μm) available from Nippon Aerosil Co., Ltd., and 1.0 part by mass of a hydrophobic silica "CAB-O-SIL TS720" (tradename) (average particle size: 0.012 μm) available from Cabot Corporation into a Henschel mixer, followed by mixing the respective materials in the mixer while stirring. The resulting mixture was then allowed to pass through a 150 mesh sieve, thereby obtaining a toner 6. Properties and evaluation results of the thus obtained toner are shown in Table 5.

Examples 6, 7, 8 and 9

Production of Toners 10, 11, 12 and 13

The same procedure as in Example 5 was repeated except that the dispersion of the releasing agent particles (W-9) was replaced with the respective dispersions of the releasing agent particles as shown in Table 1, thereby obtaining toners 10, 11, 12 and 13. Properties and evaluation results of the thus obtained toners are shown in Table 5.

Comparative Example 5

Production of Toner 14

The same procedure as in Example 5 was repeated except that the dispersion of the releasing agent particles (W-9) was replaced with the dispersion of the releasing agent particles as shown in Table 1, thereby obtaining a toner 14. Properties and evaluation results of the thus obtained toner are shown in Table 5.

Example 10

Production of Toner 15

A 2 L four-necked flask equipped with a dehydration tube, a stirrer and a thermocouple was charged with 360 g of the dispersion of the resin particles (A-5), 66 g of deionized water and 41 g of the dispersion of the releasing agent particles (W-3), and the contents of the flask were mixed with each other at 25° C. Then, while stirring the resulting mixture, an aqueous solution prepared by dissolving 16 g of ammonium sulfate in 376 g of deionized water was added dropwise to the mixture at 25° C. over 10 min. Then, the resulting dispersion was heated to 70° C. over 2 h at a temperature rise rate of 0.38° C./min. Thereafter, aggregation and fusion of the particles in the dispersion were allowed to proceed at the same time while measuring a particle size thereof and, if required, while heating the dispersion, thereby obtaining fused particles having a volume median particle size of 5.2 μm. The temperature of the dispersion upon the aggregation and fusion was 80° C.

The resulting dispersion of the fused particles was cooled to 30° C., and subjected to suction filtration to separate solid components therefrom. The thus separated solid components were rinsed with deionized water and then dried at 33° C., thereby obtaining toner particles. One hundred parts by mass of the toner particles were charged together with 2.5 parts by mass of a hydrophobic silica "RY50" (tradename) (average particle size: 0.04 μm) available from Nippon Aerosil Co., Ltd., and 1.0 part by mass of a hydrophobic silica "CAB-O-SIL TS720" (tradename) (average particle size: 0.012 μm) available from Cabot Corporation into a Henschel mixer, followed by mixing the respective materials in the mixer while stirring. The resulting mixture was then allowed to pass through a 150 mesh sieve, thereby obtaining a toner 15. Properties and evaluation results of the thus obtained toner are shown in Table 6.

Example 11

Production of Toner 16

A 2 L four-necked flask equipped with a dehydration tube, a stirrer and a thermocouple was charged with 360 g of the dispersion of the resin particles (A-6), 66 g of deionized water and 41 g of the dispersion of the releasing agent particles (W-3), and the contents of the flask were mixed with each other at 25° C. Then, while stirring the resulting mixture, an aqueous solution prepared by dissolving 31 g of ammonium sulfate in 324 g of deionized water was added dropwise to the mixture at 25° C. over 10 min. Then, the resulting dispersion was heated to 80° C. over 2 h at a temperature rise rate of 0.46° C./min. Thereafter, an aqueous solution prepared by dissolving 20 g of ammonium sulfate in 60 g of deionized water was further added to the dispersion, and aggregation and fusion of the particles in the dispersion were allowed to proceed at the same time while measuring a particle size thereof and, if required, while heating the dispersion, thereby obtaining fused particles having a volume median particle size of 4.8 μm. The temperature of the dispersion upon the aggregation and fusion was 89° C.

The resulting dispersion of the fused particles was cooled to 30° C., and subjected to suction filtration to separate solid components therefrom. The thus separated solid components were rinsed with deionized water and then dried at 33° C., thereby obtaining toner particles. One hundred parts by mass of the toner particles were charged together with 2.5 parts by mass of a hydrophobic silica "RY50" (tradename) (average particle size: 0.04 μm) available from Nippon Aerosil Co., Ltd., and 1.0 part by mass of a hydrophobic silica "CAB-O-SIL TS720" (tradename) (average particle size: 0.012 μm) available from Cabot Corporation into a Henschel mixer, followed by mixing the respective materials in the mixer while stirring. The resulting mixture was then allowed to pass through a 150 mesh sieve, thereby obtaining a toner 16. Properties and evaluation results of the thus obtained toner are shown in Table 6.

Example 12

Production of Toner 17

A 2 L four-necked flask equipped with a dehydration tube, a stirrer and a thermocouple was charged with 360 g of the dispersion of the resin particles (A-7), 55 g of deionized water and 52 g of the dispersion of the releasing agent particles (W-15), and the contents of the flask were mixed with each other at 25° C. Then, while stirring the resulting mixture, an aqueous solution prepared by dissolving 16 g of ammonium sulfate in 378 g of deionized water was added dropwise to the mixture at 25° C. over 10 min. Then, the resulting dispersion was heated to 70° C. over 2 h at a temperature rise rate of 0.38° C./min. Thereafter, aggregation and fusion of the particles in the dispersion were allowed to proceed at the same time while measuring a particle size thereof and, if required, while heating the dispersion, thereby obtaining fused particles having a volume median particle size of 5.2 μm. The temperature of the dispersion upon the aggregation and fusion was 80° C.

The resulting dispersion of the fused particles was cooled to 30° C., and subjected to suction filtration to separate solid components therefrom. The thus separated solid components were rinsed with deionized water and then dried at 33° C., thereby obtaining toner particles. One hundred parts by mass of the toner particles were charged together with 2.5 parts by mass of a hydrophobic silica "RY50" (tradename) (average particle size: 0.04 μm) available from Nippon Aerosil Co., Ltd., and 1.0 part by mass of a hydrophobic silica "CAB-O-SIL TS720" (tradename) (average particle size: 0.012 μm) available from Cabot Corporation into a Henschel mixer, followed by mixing the respective materials in the mixer while stirring. The resulting mixture was then allowed to pass through a 150 mesh sieve, thereby obtaining a toner 17. Properties and evaluation results of the thus obtained toner are shown in Table 6.

Example 13

Production of Toner 18

A 2 L four-necked flask equipped with a dehydration tube, a stirrer and a thermocouple was charged with 360 g of the dispersion of the resin particles (A-8), 66 g of deionized water and 41 g of the dispersion of the releasing agent particles (W-3), and the contents of the flask were mixed with each other at 25° C. Then, while stirring the resulting mixture, an aqueous solution prepared by dissolving 16 g of ammonium sulfate in 240 g of deionized water was added dropwise to the mixture at 25° C. over 10 min. Then, the resulting dispersion was heated to 75° C. over 2 h at a temperature rise rate of 0.41° C./min. Thereafter, aggregation and fusion of the particles in the dispersion were allowed to proceed at the same time while measuring a particle size thereof and, if required, while heating the dispersion, thereby obtaining fused particles having a volume median particle size of 5.2 μm. The temperature of the dispersion upon the aggregation and fusion was 83° C. The resulting dispersion of the fused particles was cooled to 30° C., and subjected to suction filtration to separate solid components therefrom. The thus separated solid components were rinsed with deionized water and then dried at 33° C., thereby obtaining toner particles. One hundred parts by mass of the toner particles were charged together with 2.5 parts by mass of a hydrophobic silica "RY50" (tradename) (average particle size: 0.04 μm) available from Nippon Aerosil Co., Ltd., and 1.0 part by mass of a hydrophobic silica "CAB-O-SIL TS720" (tradename) (average particle size: 0.012 μm) available from Cabot Corporation into a Henschel mixer, followed by mixing the respective materials in the mixer while stirring. The resulting mixture was then allowed to pass through a 150 mesh sieve, thereby obtaining a toner 18. Properties and evaluation results of the thus obtained toner are shown in Table 6.

TABLE 5

| | Examples/Comparative Examples | | | | | | | |
|---|---|---|---|---|---|---|---|---|
| | Examples | | | | Comparative Examples | | | |
| | 1 | 2 | 3 | 4 | 1 | 2 | 3 | 4 |
| Toner | Toner 1 | Toner 2 | Toner 3 | Toner 4 | Toner 5 | Toner 6 | Toner 7 | Toner 8 |
| Dispersion of resin particles (A) for core (solid content: 30%) | | | | | | | | |
| A-1 | 250 g | 250 g | 250 g | 250 g | 250 g | 250 g | 250 g | 250 g |
| A-3 | | | | | | | | |
| A-5 | | | | | | | | |
| A-6 | | | | | | | | |
| A-7 | | | | | | | | |
| A-8 | | | | | | | | |
| Dispersion of resin particles (B) for shell (solid content: 16.5%) | | | | | | | | |
| A-2 | 126 g | 126 g | 126 g | 126 g | 126 g | 126 g | 126 g | 126 g |
| A-4 | | | | | | | | |
| Dispersion of releasing agent particles (solid content: 20%) | | | | | | | | |
| Kind | W-1 | W-2 | W-3 | W-4 | W-5 | W-6 | W-7 | W-8 |
| Amount compounded | 35 g | 35 g | 35 g | 35 g | 35 g | 35 g | 35 g | 35 g |
| Evaluation of toner | | | | | | | | |
| Condition of liberation of wax in fusing step (observed by naked eyes) | *1 | *1 | *1 | *2 | *2 | *1 | *1 | *3 |

TABLE 5-continued

| | | | | | | | | |
|---|---|---|---|---|---|---|---|---|
| Extent of exposure of wax onto surface of toner (observed by electron microscope) | *4 | *4 | *4 | *4 | *7 | *7 | *7 | *4 |
| Content of fine powders (not more than 2 μm) in toner (%; number ratio) | 3.6 | 2.2 | 2.9 | 3.9 | 17.0 | 15.8 | 11.0 | 4.4 |
| Fusing region of toner (low-temperature fusing temperature to high-temperature offset temperature [° C.]) | 120-165° C. | 120-165° C. | 120-170° C. | 120-160° C. | 120-170° C. | 120-160° C. | 120-160° C. | *8 |
| Heat-resistant storage stability of toner at 55° C. (blocking amount in 20 g of toner) | 0.35 g | 0.09 g | 0.09 g | 0.01 g | 0.12 g | 0.03 g | 0.34 g | 0.03 g |
| Circularity of toner particles | 0.991 | 0.985 | 0.989 | 0.987 | 0.986 | 0.982 | 0.984 | 0.990 |
| Tribocharge of toner [−μC/g] | 35 | 35 | 34 | 36 | 18 | 16 | 16 | 28 |
| Volume median particle size ($D_{50}$) of toner particles (μm) | 4.7 | 4.9 | 4.9 | 4.8 | 4.8 | 5.3 | 5.0 | 4.9 |

| | Example/Comparative Example | | | | | |
|---|---|---|---|---|---|---|
| | Examples | | | | | Comp. |
| | 5 | 6 | 7 | 8 | 9 | Ex. 5 |
| Toner | Toner 9 | Toner 10 | Toner 11 | Toner 12 | Toner 13 | Toner 14 |
| Dispersion of resin particles (A) for core (solid content: 30%) | | | | | | |
| A-1 | | | | | | |
| A-3 | 250 g | 250 g | 250 g | 250 g | 250 g | 250 g |
| A-5 | | | | | | |
| A-6 | | | | | | |
| A-7 | | | | | | |
| A-8 | | | | | | |
| Dispersion of resin particles (B) for shell (solid content: 16.5%) | | | | | | |
| A-2 | | | | | | |
| A-4 | 126 g | 126 g | 126 g | 126 g | 126 g | 126 g |
| Dispersion of releasing agent particles (solid content: 20%) | | | | | | |
| Kind | W-9 | W-10 | W-11 | W-12 | W-13 | W-14 |
| Amount compounded | 52 g | 52 g | 52 g | 52 g | 52 g | 52 g |
| Evaluation of toner | | | | | | |
| Condition of liberation of wax in fusing step (observed by naked eyes) | *1 | *1 | *1 | *1 | *1 | *1 |
| Extent of exposure of wax onto surface of toner (observed by electron microscope) | *4 | *5 | *6 | *6 | *5 | *7 |
| Content of fine powders (not more than 2 μm) in toner (%; number ratio) | 3.4 | 3.4 | 3.2 | 4.3 | 3.2 | 17.2 |
| Fusing region of toner (low-temperature fusing temperature to high-temperature offset temperature [° C.]) | 115-160° C. | 115-165° C. | 115-160° C. | 115-160° C. | 115-145° C. | 115-160° C. |
| Heat-resistant storage stability of toner at 55° C. (blocking amount in 20 g of toner) | 0.01 g | 0.05 g | 0.04 g | 0.06 g | 0.19 g | 6.67 g |
| Circularity of toner particles | 0.992 | 0.989 | 0.983 | 0.988 | 0.99 | 0.975 |
| Tribocharge of toner [−μC/g] | 30 | 25 | 22 | 25 | 30 | 15 |
| Volume median particle size ($D_{50}$) of toner particles (μm) | 5.4 | 5.2 | 5.0 | 5.1 | 4.9 | 5.3 |

Note
*1: Transparent;
*2: Slightly whitely turbid;
*3: Severely whitely turbid;
*4: Very small;
*5: Small;
*6: Slightly large;
*7: Large;
*8: Not fused

TABLE 6

| | Examples/Comparative Examples Examples | | | |
|---|---|---|---|---|
| | 10 | 11 | 12 | 13 |
| Toner | Toner 15 | Toner 16 | Toner 17 | Toner 18 |
| Dispersion of resin particles (A) for core (solid content: 30%) | | | | |
| A-1 | | | | |
| A-3 | | | | |
| A-5 | 360 g | | | |
| A-6 | | 360 g | | |
| A-7 | | | 360 g | |
| A-8 | | | | 360 g |
| Dispersion of resin particles (B) for shell (solid content: 16.5%) | | | | |
| A-2 | | | | |
| A-4 | | | | |
| Dispersion of releasing agent particles (solid content: 20%) | | | | |
| Kind | W-3 | W-3 | W-15 | W-3 |
| Amount compounded | 41 g | 41 g | 52 g | 41 g |
| Evaluation of toner | | | | |
| Condition of liberation of wax in fusing step (observed by naked eyes) | Transparent | Transparent | Transparent | Transparent |
| Extent of exposure of wax onto surface of toner (observed by electron microscope) | Very small | Very small | Very small | Very small |
| Content of fine powders (not more than 2 μm) in toner (%; number ratio) | 4.0 | 2.3 | 3.6 | 3.1 |
| Fusing region of toner (low-temperature fusing temperature to high-temperature offset temperature [° C.]) | 115-135° C | 115-160° C. | 110-130° C. | 130-170° C. |
| Heat-resistant storage stability of toner at 55° C. (blocking amount in 20 g of toner) | 0.15 g | 0.05 g | 0.03 g | 0.04 g |
| Circularity of toner particles | 0.946 | 0.958 | 0.950 | 0.943 |
| Tribocharge of toner [-μC/g] | 29 | 41 | 33 | 44 |
| Cleaning property of toner | A | B | A | A |
| Volume median particle size ($D_{50}$) of toner particles (μm) | 5.2 | 4.8 | 5.2 | 5.2 |

From Table 5, it was confirmed that in Examples 1, 2, 3 and 4 in which the dispersions of the releasing agent particles (W-1), (W-2), (W-3) and (W-4) each prepared by mixing and emulsifying the wax, the resin emulsion containing the resin having an acid value of from 10 to 300 mgKOH/g and the oxazoline group-containing polymer with each other, upon production of the water dispersion of the releasing agent particles, were respectively used, it was possible to suppress liberation of the wax as well as exposure of the wax to a surface of the toner upon production of the toner, so that the resulting toners for electrophotography were excellent in low-temperature fusing property and anti-high-temperature offset property.

Also, it was confirmed that the toner using the releasing agent particles W-2 prepared by mixing and reacting the wax mixture and the oxazoline group-containing polymer with each other and then adding the resin emulsion having an acid value to the obtained reaction mixture was more excellent in content of fine powders therein and heat-resistant storage stability than the toner using the releasing agent particles W-1 prepared by mixing and reacting the wax mixture, the oxazoline group-containing polymer and the resin emulsion having an acid value with each other at the same time.

In addition, in Examples 2 and 3 in which the hydrocarbon wax was used in combination with the ester wax, the resulting toner exhibited less liberation of the wax upon fusing the particles and was more excellent in anti-high-temperature offset property than the toner obtained in Example 4 in which the hydrocarbon wax only was used.

On the other hand, in Comparative Example 1 in which the dispersion of the releasing agent particles (W-5) prepared by adding no oxazoline group-containing polymer and dispersing the releasing agent particles in water with the resin emulsion having an acid value upon production of the water dispersion of the releasing agent particles was used, the resulting toner suffered from occurrence of liberation of the wax and a large extent of exposure of the wax to a surface of the toner upon production of the toner, as well as a large content of fine powders in the toner. Also, in Comparative Examples 2 and 3 in which the dispersions of the releasing agent particles (W-6) and (W-7) each prepared by adding the oxazoline group-containing polymer to the wax mixture and then dispersing the releasing agent particles in water with the surfactant or the fatty acid upon production of the dispersion of the releasing agent particles were respectively used, although liberation of the wax from the fused particles upon production of the toner was suppressed, there occurred a large extent of exposure of the wax to a surface of the toner, as well as a large content of fine powders in the toner.

As shown in Examples 5 to 9, even when the amount of the releasing agent particles compounded in the toner was increased 1.5 times, it was possible to suppress liberation of the wax as well as exposure of the wax to a surface of the toner upon production of the toner, so that the toners for electrophotography produced in Examples 5 to 9 were excellent in low-temperature fusing property and anti-high-temperature offset property.

Furthermore, in Comparative Example 5 in which the dispersion of the releasing agent particles (W-14) prepared by adding the oxazoline group-containing polymer to the wax mixture and then dispersing the releasing agent particles in water with the resin aqueous solution having an acid value upon production of the water dispersion of the releasing agent particles was used, although liberation of the wax from the fused particles upon production of the toner was suppressed, there occurred a large extent of exposure of the wax to a surface of the toner, as well as a large content of fine powders in the toner.

From Table 6, it was further confirmed that in Examples 10 to 13, the resulting toner particles had a low circularity and were excellent in cleaning property.

Meanwhile, in Examples 10 and 12 in which no oxazoline group-containing copolymer was used upon production of the resin particles, the resulting toners were slightly deteriorated in anti-high-temperature offset property, whereas in Example 13 in which no crystalline polyester was used, the resulting toner was slightly deteriorated in low-temperature fusing property.

From the aforementioned results, it was confirmed that when using the releasing agent particles prepared by adding the oxazoline group-containing polymer to the wax mixture and then dispersing the releasing agent particles in water with the resin emulsion having an acid value upon production of the water dispersion of the releasing agent particles, it was possible to suppress liberation of the releasing agent from the fused particles as well as exposure of the releasing agent to a surface of the toner upon production of the toner, and the use of such releasing agent particles in the toner was most effective to reduce a content of fine powders in the toner.

INDUSTRIAL APPLICABILITY

The toner for electrophotography obtained according to the production process of the present invention can be prevented from suffering from liberation of a wax from fused particles and exposure of the wax to a surface of the toner upon production of the toner, can exhibit a less content of finer powders therein, and is excellent in low-temperature fusing property and anti-high-temperature offset property. Therefore, the toner for electrophotography obtained according to the production process of the present invention can be suitably used as a toner for electrophotography which is employed in electrophotographic method, electrostatic recording method, electrostatic printing method, etc. According to the process of the present invention, it is possible to efficiently produce the toner having the aforementioned properties.

The invention claimed is:

1. A process for producing a toner for electrophotography, the process comprising:

mixing and emulsifying a wax, a resin emulsion containing a resin having an acid value of from 10 to 300 mgKOH/g, and an oxazoline group-containing polymer with each other to obtain a water dispersion of releasing agent particles;

mixing and aggregating the water dispersion of the releasing agent particles obtained in the mixing and emulsifying with a water dispersion of resin particles containing a carboxyl group-containing resin binder to obtain aggregated particles; and fusing the aggregated particles obtained in the mixing and aggregating to obtain fused particles, wherein in the mixing and emulsifying, a content of solid components in the resin emulsion is from 0.1 to 15 parts by mass on the basis of 100 parts by mass of a whole amount of the wax.

2. The process for producing a toner for electrophotography according to claim 1, wherein in the mixing and emulsifying, a molar ratio of an acid group contained in the resin emulsion to an oxazoline group contained in the oxazoline group-containing polymer (acid group/oxazoline group) is from 0.05 to 10.

3. The process for producing a toner for electrophotography according to claim 1, wherein in the mixing and emulsifying, a content of solid components in the resin emulsion is from 0.5 to 10 parts by mass on the basis of 100 parts by mass of a whole amount of the wax.

4. The process for producing a toner for electrophotography according to claim 1, wherein the releasing agent particles obtained in the mixing and emulsifying have a volume-median particle size ($D_{50}$) of from 300 to 1000 nm.

5. The process for producing a toner for electrophotography according to claim 1, wherein the resin emulsion used in the mixing and emulsifying is at least one resin emulsion selected from the group consisting of a vinyl chloride-based resin emulsion, an acryl-based resin emulsion and a polyester resin emulsion.

6. The process for producing a toner for electrophotography according to claim 1, wherein the mixing and emulsifying further comprises controlling the volume-median particle size ($D_{50}$) of the releasing agent particles within the range of from 450 to 800 nm using an acid or an alkali.

7. The process for producing a toner for electrophotography according to claim 1, wherein the wax used in the mixing and emulsifying is in the form of a wax mixture containing a hydrocarbon wax and an ester wax containing a carboxyl group and having an acid value of from 0.5 to 20 mgKOH/g, and a mass ratio of the ester wax to the hydrocarbon wax (ester wax/hydrocarbon wax) is from 5/95 to 50/50.

8. The process for producing a toner for electrophotography according to claim 7, wherein the ester wax is a carnauba wax.

9. The process for producing a toner for electrophotography according to claim 1, wherein in the mixing and emulsifying, after mixing the wax and the oxazoline group-containing polymer with each other, the obtained mixture is mixed and emulsified with the resin emulsion to obtain the water dispersion of the releasing agent particles.

10. The process for producing a toner for electrophotography according to claim 1, wherein the resin particles containing the carboxyl group-containing resin binder contain a crystalline polyester and a non-crystalline polyester.

11. The process for producing a toner for electrophotography according to claim 10, wherein the crystalline polyester is obtained by polycondensing an alcohol component containing an $\alpha,\omega$-alkanediol having 10 to 12 carbon atoms and an acid component containing an aliphatic dicarboxylic acid.

12. The process for producing a toner for electrophotography according to claim 1, wherein the emulsification in the mixing and emulsifying is carried out at a temperature of from 50 to 120° C.

* * * * *